US009421503B2

(12) United States Patent
An et al.

(10) Patent No.: US 9,421,503 B2
(45) Date of Patent: Aug. 23, 2016

(54) REFRIGERATOR EQUIPPED WITH APPARATUS FOR PRODUCING CARBONATED WATER

(71) Applicant: SAMSUNG ELECTRONICS CO., LTD., Suwon-si, Gyeonggi-do (KR)

(72) Inventors: Jae Koog An, Gwangju (KR); Kyung Ho Hwang, Anyang-si (KR); Sang Min Park, Gwangju (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 157 days.

(21) Appl. No.: 14/189,600

(22) Filed: Feb. 25, 2014

(65) Prior Publication Data

US 2014/0239518 A1 Aug. 28, 2014

(30) Foreign Application Priority Data

Feb. 28, 2013 (KR) ..... 10-2013-0022345

(51) Int. Cl.
*B01F 3/04* (2006.01)
*F25D 23/12* (2006.01)

(52) U.S. Cl.
CPC ..... *B01F 3/04808* (2013.01); *B01F 3/04106* (2013.01); *F25D 23/126* (2013.01)

(58) Field of Classification Search
CPC ..... B01F 3/04; B01F 3/04099; B01F 3/04106
USPC ..... 261/43, 64.1, 66, 74, 76, 77, 121.1, 261/DIG. 7; 99/323.1
See application file for complete search history.

(56) References Cited

U.S. PATENT DOCUMENTS

| | | | | |
|---|---|---|---|---|
| 2,782,016 | A | 2/1957 | Iannelli et al. | |
| 4,514,994 | A | 5/1985 | Mabb | |
| 5,399,300 | A | 3/1995 | Notar | |
| 5,792,391 | A | 8/1998 | Vogel et al. | |
| 6,113,080 | A | 9/2000 | Kazuma | |
| 7,967,279 | B2 * | 6/2011 | Monti | B67D 1/007 261/43 |

FOREIGN PATENT DOCUMENTS

| | | | |
|---|---|---|---|
| EP | 2465601 | A1 | 6/2012 |
| GB | 2483073 | | 2/2012 |
| KR | 10-2006-0000202 | | 1/2006 |
| KR | 10-2011-0094796 | | 8/2011 |
| WO | 2009/057854 | A1 | 5/2009 |
| WO | 2011/124702 | | 10/2011 |

OTHER PUBLICATIONS

PCT International Search Report mailed May 8, 2014 in corresponding International Patent Application No. PCT/KR2014/001430.
Extended European Search Report issued Mar. 13, 2015 in corresponding European Patent Application No. 14156992.1.
Korean Office Action issued Apr. 11, 2016 in corresponding Korean Patent Application 10-2013-0022345.
European Office Action issued Mar. 16, 2016 in corresponding European Patent Application 14 156 992.1.

* cited by examiner

*Primary Examiner* — Robert A Hopkins
(74) *Attorney, Agent, or Firm* — Staas & Halsey LLP

(57) ABSTRACT

A refrigerator is disclosed. The refrigerator includes a body, a carbonated water tank to produce carbonated water through mixing of clean water with carbon dioxide gas, a sensor unit inserted, at least a portion thereof, into the carbonated water tank, to sense an internal state of the carbonated water tank, and a holding unit disposed at one side of the carbonated water tank while holding the sensor unit in a fixed state. Through this configuration, it is possible to achieve easy coupling of the sensor unit and lines to the carbonated water tank while preventing water leakage even when the internal pressure of the carbonated water tank is high.

25 Claims, 26 Drawing Sheets

REFRIGERATOR EQUIPPED WITH APPARATUS FOR PRODUCING CARBONATED WATER

CROSS-REFERENCE TO RELATED APPLICATIONS

This application claims the benefit of Korean Patent Application No. 10-2013-0022345, filed on Feb. 28, 2013 in the Korean Intellectual Property Office, the disclosure of which is incorporated herein by reference.

BACKGROUND

1. Field

Embodiments of the present disclosure relate to coupling of a carbon dioxide gas cylinder in a refrigerator equipped with an apparatus for producing carbonated water.

2. Description of the Related Art

A refrigerator is a home appliance including a storage chamber to store food, and a cold air supplier to supply cold air to the storage chamber in order to keep food fresh. To satisfy consumer demand, such a refrigerator may be provided with an icemaker to make ice, and a dispenser to allow the user to take water or ice out of the refrigerator from outside of the refrigerator without opening a door.

The refrigerator may also be provided with a carbonated water production apparatus for producing carbonated water. The carbonated water production apparatus includes a carbon dioxide gas cylinder storing high-pressure carbon dioxide gas, and a carbonated water tank to produce carbonated water through mixing of carbon dioxide gas with water.

Carbonated water produced in the carbonated water tank may be connected to an external dispensation space via a dispenser in order to allow the user to retrieve carbonated water from outside of the refrigerator without opening the door.

In order to check an internal state of the carbonated water tank which produces and discharges carbonated water, for handling of carbonated water, it is necessary to install a sensor capable of sensing an internal state of the carbonated water tank. When the sensor is directly coupled to the carbonated water tank, or lines to guide carbonated water, clean water, and carbon dioxide gas, for introduction and discharge thereof, are directly coupled to the carbonated water tank, coupling areas may exhibit weak resistance to pressure or water leakage may occur at the coupling areas.

Meanwhile, since high-pressure carbon dioxide gas is introduced into the carbonated water tank, and carbonated water is stored in the carbonated water tank, the carbonated water tank is typically made of a material exhibiting high resistance to pressure and rust. When the sensor or lines are directly coupled to the carbonated water tank, which is made of the above-mentioned material, it may be difficult to obtain firm coupling.

SUMMARY

Therefore, it is an aspect of the present disclosure to provide a refrigerator having a carbonated water tank exhibiting high resistance to pressure while being capable of preventing leakage of water.

Additional aspects will be set forth in part in the description which follows and, in part, will be obvious from the description, or may be learned by practice of the invention.

In accordance with one aspect, a refrigerator includes a body, a carbonated water tank to produce carbonated water through mixing of clean water with carbon dioxide gas, a sensor unit inserted, at least a portion thereof, into the carbonated water tank, to sense an internal state of the carbonated water tank, and a holding unit disposed at one side of the carbonated water tank while holding the sensor unit in a fixed state.

The holding unit may have a cover shape to cover one side of the carbonated water tank.

The holding unit may include a holding plate, to which the sensor unit is fixed, and a plate support provided at a peripheral portion of the holding plate, to be supported by the carbonated water tank.

The refrigerator may further include a gasket provided between the carbonated water tank and the holding unit such that the gasket contacts one side of the carbonated water tank, to prevent occurrence of water leakage from the carbonated water tank.

The carbonated water tank may include a tank hole formed at one side of the carbonated water tank, to receive the at least a portion of the sensor unit.

The holding unit may further include a unit guide extending from a lower surface of the holding plate, to have a protruded shape, the unit guide having a hollow portion to guide the sensor unit.

The sensor unit may include a water level sensor. The holding unit may include a sensor seat to fix the water level sensor.

The water level sensor may include a sensor flange provided at one end of the water level sensor, to be seated on the sensor seat.

The water level sensor may be fixed, at one end thereof, to the holding unit while being provided, at the other end thereof, with a water level sensing rod extending into the carbonated tank.

The water level sensing rod may include a ground rod to set a reference for sensing of water level, a low water level sensing rod having a long length, to approach a bottom of the carbonated water tank so as to sense a low water level, and a high water level sensing rod having a shorter length than the low water level sensing rod, to approach a top of the carbonated water tank so as to sense a high water level.

The refrigerator may further include lines to guide the clean water, the carbon dioxide gas, and the carbonated water. The holding unit may include fitting tubes each fixed, at one end thereof, to the holding unit while communicating, at the other end thereof, with a corresponding one of the lines.

The carbonated water tank may be provided, at one side thereof, with line guides extending from the carbonated water tank, to have a protruded shape, each of the line guides having hollow portion to be coupled, at an end thereof, with one end of a corresponding one of the fitting tubes.

The refrigerator may further include a water tank to store the clean water, and a carbon dioxide gas cylinder stored with the carbon dioxide gas.

The sensor unit may be threadedly coupled to the holding unit.

The carbonated water tank may be made of a stainless steel material.

In accordance with one aspect, a refrigerator includes a body, a storage chamber defined in the body while having an opened front side, a door to open or close the opened front side of the storage chamber, a water tank to store clean water, a carbonated water production module mounted to a back surface of the door, the carbonated water production module including a carbon dioxide gas cylinder stored with carbon dioxide gas, and a carbonated water tank to produce carbonated water through mixing of the clean water with the carbon dioxide gas, a sensor unit to sense an internal state of the carbonated water tank, and a holding unit disposed at one side of the carbonated water tank while holding the sensor unit and lines to guide the clean water and the carbon dioxide gas in a fixed state.

The refrigerator may further include a gasket provided between the carbonated water tank and the holding unit such that the gasket contacts one side of the carbonated water tank, to prevent leakage of the carbonated water.

The sensor unit may include at least one of a water level sensor to sense a water level of the carbonated water tank, a relief valve to adjust an excessive internal pressure of the carbonated water tank, and a temperature sensor to sense a temperature of the carbonated water in the carbonated water tank.

In accordance with one aspect, a refrigerator includes a body, a storage chamber defined in the body while having an opened front side, a door to open or close the opened front side of the storage chamber, and a carbonated water production module mounted to a back surface of the door, to produce carbonated water, wherein the carbonated water tank includes a carbonated water tank to produce and store carbonated water, and a holding unit disposed at one side of the carbonated water tank while being inserted, at least a portion thereof, into the carbonated water tank, to hold at least one sensor unit in a fixed state.

The refrigerator may further include a gasket provided between the carbonated water tank and the holding unit such that the gasket contacts one side of the carbonated water tank, to prevent occurrence of water leakage from the carbonated water tank.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Reference will now be made in detail to the preferred embodiments, examples of which are illustrated in the accompanying drawings.

Figure 1:
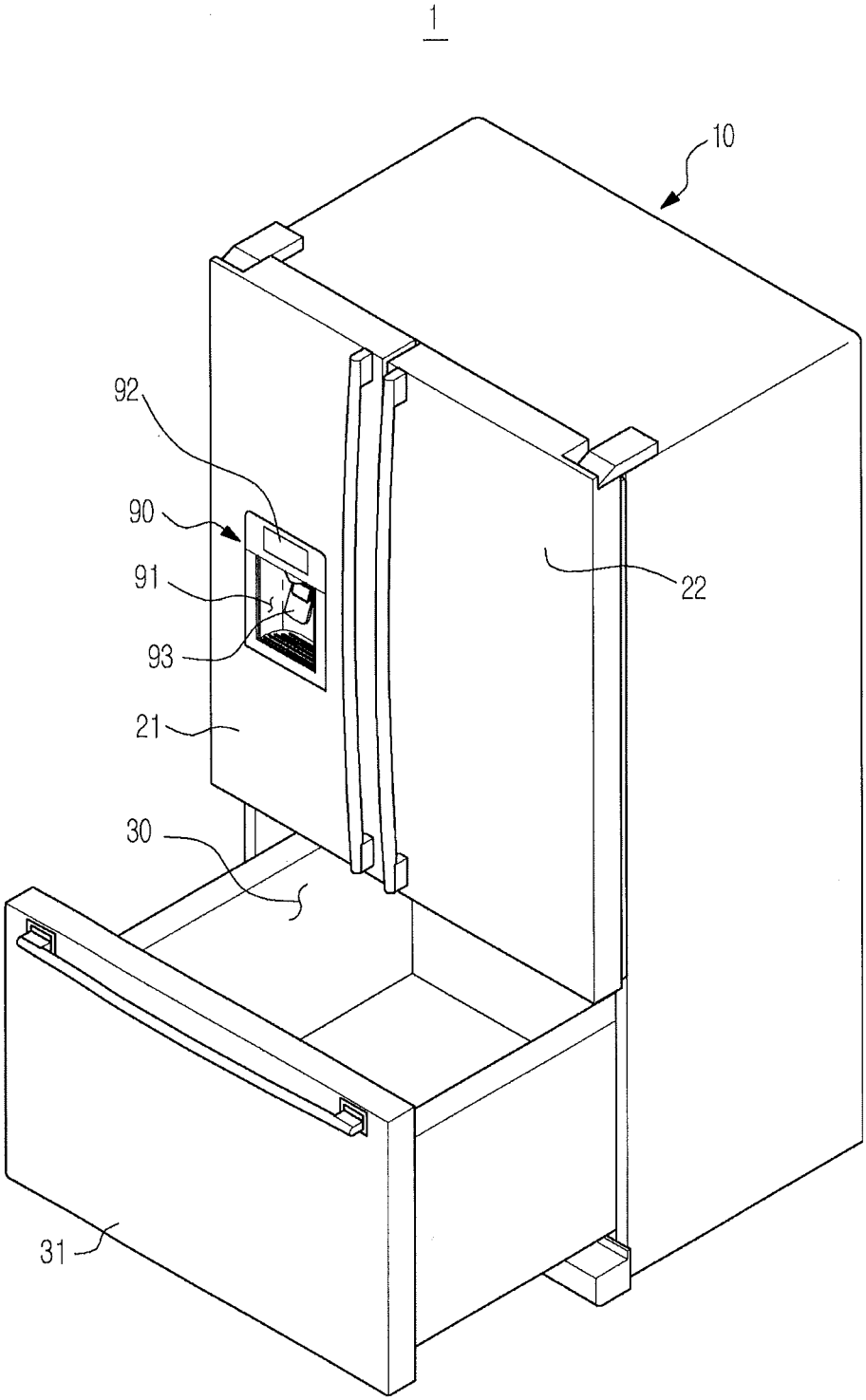
FIG. 1 is a perspective view illustrating an appearance of a refrigerator according to an embodiment.
Figure 2:
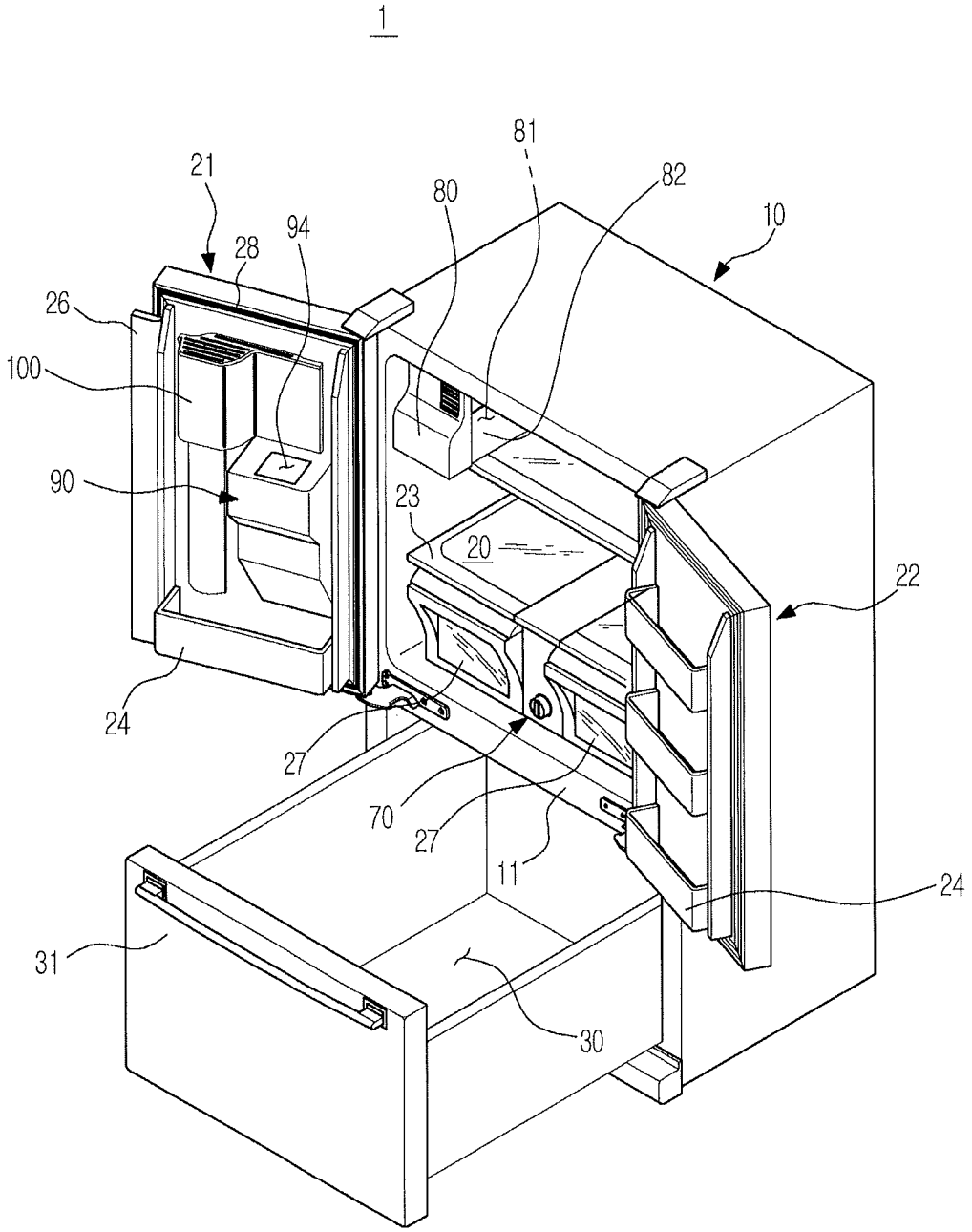
FIG. 2 is a perspective view illustrating an interior of the refrigerator illustrated in FIG. 1.

FIG. 1 is a perspective view illustrating an appearance of a refrigerator according to an embodiment. FIG. 2 is a perspective view illustrating an interior of the refrigerator illustrated in FIG. 1.

Referring to FIGS. 1 and 2, the refrigerator according to the illustrated embodiment of the present invention which is designated by reference numeral "1" may include a body 10, and a storage chambers 20 and 30 defined in an interior of the body 10. The refrigerator 1 may further include a cold air supplier (not shown).

The body 10 may include an inner case to define the storage chambers 20 and 30, and an outer case coupled to the inner case at an outside of the inner case, to define the appearance of the refrigerator 1, and an insulator disposed between the inner and outer cases, to insulate the storage chambers 20 and 30.

The storage chambers 20 and 30 may be divided into an upper refrigerating compartment 20 and a lower freezing compartment 30 by an intermediate barrier wall 11. The refrigerating compartment 20 is kept at a temperature of 3° C., to store food in a refrigerated state, whereas the freezing compartment 30 is kept at a temperature of −18.5° C., to store food in a frozen state. Racks 23 may be provided at the refrigerating compartment 20, to place food thereon. In the refrigerating compartment 20, at least one storage box 27 may also be provided to store food in a closed state.

In addition, an ice making compartment 81 to produce ice may be provided at an upper corner of the refrigerating compartment 20. The ice making compartment 81 may be partitioned from the refrigerating compartment 20 by an ice making compartment case 82. In the ice making compartment 81, an icemaker 80 may be provided. The icemaker 80 may include an ice making tray to produce ice, and an ice bucket to store ice produced in the ice making tray.

Meanwhile, a water tank 70 capable of storing water may be provided at the refrigerating compartment 20. When a plurality of storage boxes 27 is provided, the water tank 70 may be disposed between adjacent ones of the storage boxes 27, as illustrated in FIG. 2. Of course, embodiments of the present invention are not limited to the illustrated case. The water tank 70 may be disposed at any position, so long as it is disposed within the refrigerating compartment 20 in order to cool water stored in the water tank 70 by cold air present in the refrigerating compartment 20.

Figure 5:
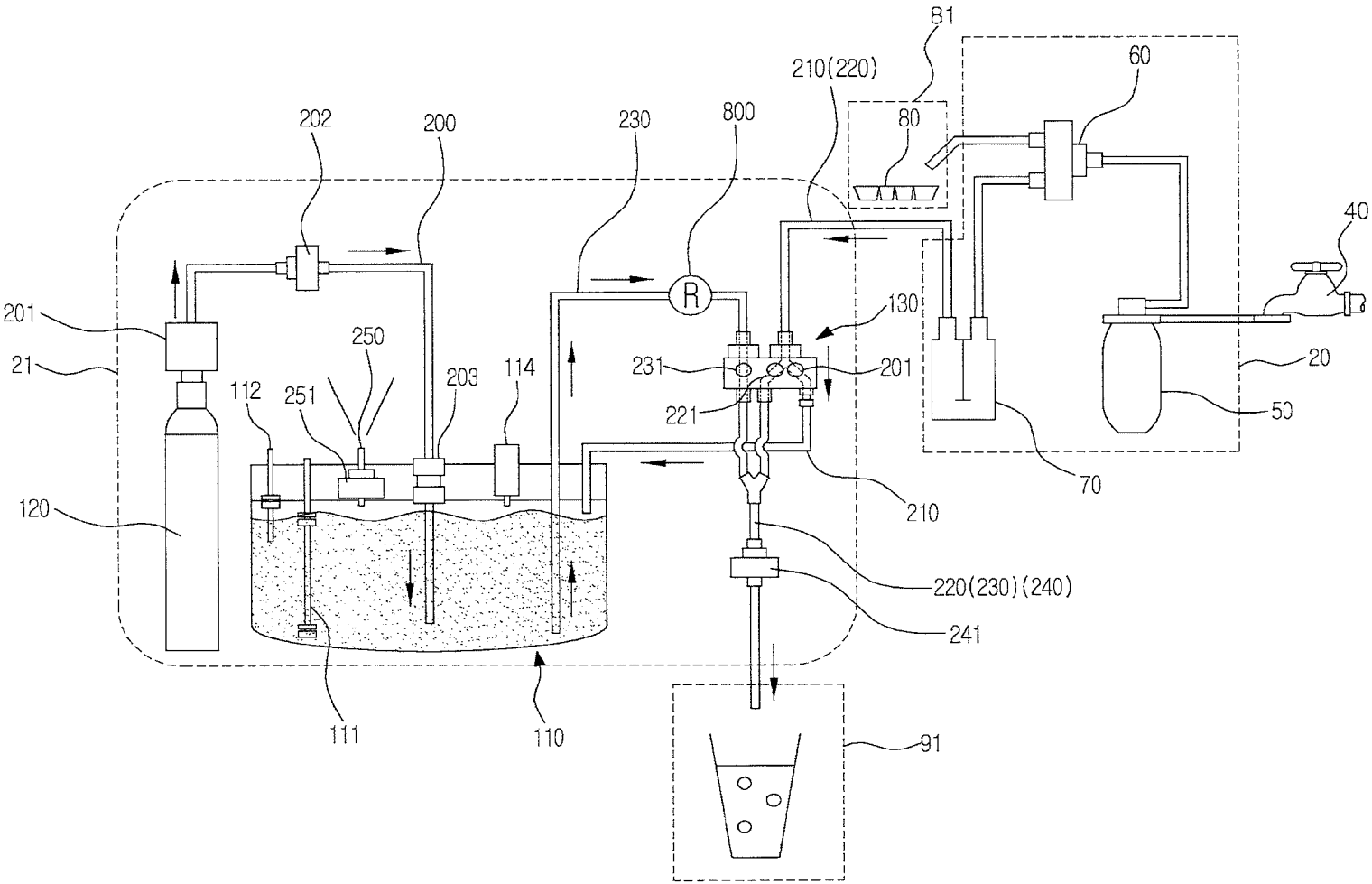
FIG. 5 is a conceptual view explaining carbonated water production and discharge procedures in the refrigerator of FIG. 1.

The water tank 70 may be connected to an external water supply source 40 (FIG. 5) such as a tap water supply source. The water tank 70 may store clean water purified by a purification filter 50 (FIG. 5). A path change valve 60 may be provided at a water supply tube to connect the water tank 70 to the external water supply source 40. Through the path change valve 50, water may be supplied to the icemaker 80.

Each of the refrigerating compartment 20 and freezing compartment 30 has an opened front side to allow food to be place therein or retrieved therefrom. The opened front side of the refrigerating compartment 20 may be opened or closed by a pair of pivotable doors 21 and 22 pivotally coupled to the body 10. The opened front side of the freezing compartment 30 may be opened or closed by a sliding door 31 slidable with respect to the body 10. Door guards 24 capable of storing food may be provided at back surfaces of the refrigerating compartment doors 21 and 22.

Meanwhile, a gasket 28 is provided along an edge of each refrigerating compartment door 21 or 22 at the back surface of the refrigerating compartment door 21 or 22, to confine cold air in the refrigerating compartment 20 by providing a seal between the refrigerating compartment door 21 or 22 and the body 10. A pivotable bar 26 may be provided at one of the refrigerating compartment doors 21 and 22, for example, the refrigerating compartment door 21, to provide a seal between the refrigerating compartment doors 21 and 22 when the refrigerating compartment doors 21 and 22 are closed, and thus to prevent cold air from leaking from the refrigerating compartment 20.

In addition, a dispenser 90 may be provided at one of the refrigerating compartment doors 21 and 22, for example, the refrigerating compartment door 21, to allow the user to retrieve water or ice stored in the refrigerator 1 from the outside of the refrigerator 1 without opening the refrigerating compartment door 21.

The dispenser 90 may include a dispensation space 91 to receive a container such as a cup in order to dispense water or ice into the container, a control panel 92 provided with input buttons to manipulate various settings of the dispenser 90 and a display to display various information of the dispenser 90, and an operating lever 93 to operate the dispenser 90, for dispensation of water or ice.

The dispenser 90 may also include an ice guide passage 94 to connect the dispensation space 91 to the icemaker 80 in order to discharge ice produced in the icemaker 80 into the dispensation space 91.

Meanwhile, in the refrigerator 1 according to the illustrated embodiment, a carbonated water production module 100 to produce carbonated water may be mounted to the back surface of the refrigerating compartment door 21 where the dispenser 90 is provided. Hereinafter, the carbonated water production module 100 will be described in detail.

Figure 3:
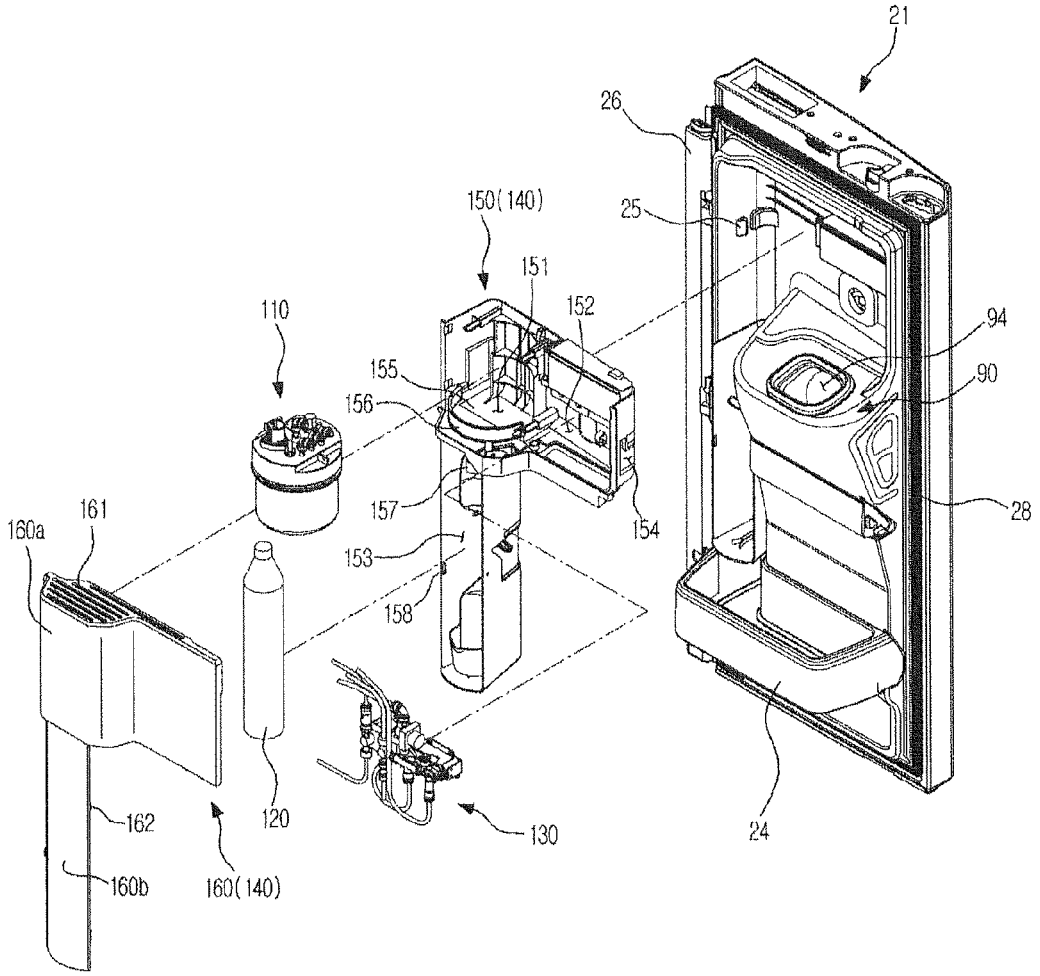
FIG. 3 is an exploded perspective view illustrating an assembled structure of a carbonated water production module in the refrigerator of FIG. 1.
Figure 4:
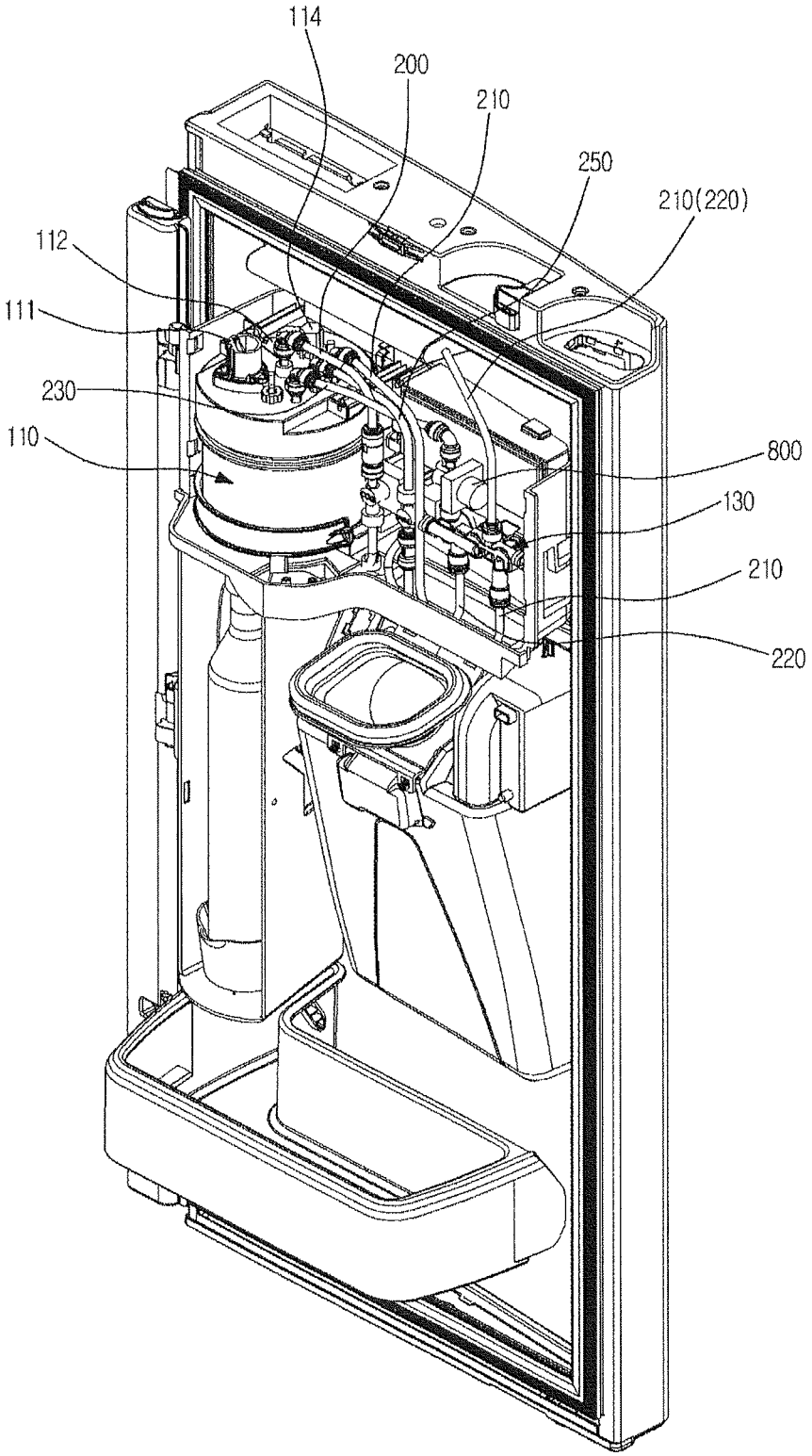
FIG. 4 is a perspective view illustrating the carbonated water production module in the refrigerator of FIG. 1 in a state in which a cover is separated.

FIG. 3 is an exploded perspective view illustrating an assembled structure of the carbonated water production module in the refrigerator of FIG. 1. FIG. 4 is a perspective view illustrating the carbonated water production module in the refrigerator of FIG. 1 in a state in which a cover is separated. FIG. 5 is a conceptual view explaining carbonated water production and discharge procedures in the refrigerator of FIG. 1.

The carbonated water production module 100 functions to produce carbonated water within the refrigerator 1. As illustrated in FIGS. 3 to 5, the carbonated water production module 100 may include a carbon dioxide gas cylinder 120 stored therein with high-pressure carbon dioxide gas, and a carbonated water tank 110 to produce carbonated water through mixing of clean water with carbon dioxide gas. The carbonated water production module 100 also includes a module case 140 coupled to the back surface of the refrigerating compartment door 21 while being defined therein with accommodation spaces 151, 152, and 153 to receive the carbon dioxide gas cylinder 120 and carbonated water tank 110, and a valve assembly 130.

Carbon dioxide gas at a high pressure of 45 to 60 bars may be stored in the carbon dioxide gas cylinder 120. The carbon dioxide gas cylinder 120 may be received in the lower accommodation space 153 while being mounted to a cylinder connector 157 of the module case 140.

Carbon dioxide gas in the carbon dioxide gas cylinder 120 may be supplied to the carbonated water tank 110 through a carbon dioxide gas supply line 200 which interconnects the carbon dioxide gas cylinder 120 and carbonated water tank 110.

The carbon dioxide gas supply line 200 may be provided with a carbon dioxide gas regulator 201 to adjust the pressure of carbon dioxide gas, a carbon dioxide gas supply valve 202 to open or close the carbon dioxide gas supply line 200, and a carbon dioxide gas backflow prevention valve 203 to prevent backflow of carbon dioxide gas.

The carbon dioxide gas regulator 201 may adjust the pressure of carbon dioxide gas discharged from the carbon dioxide gas cylinder 120 and, as such, pressure-adjusted carbon dioxide gas may be supplied to the carbonated water tank 110. The carbon dioxide gas regulator 201 may reduce the pressure of carbon dioxide gas to about 10 bars.

The carbonated water tank 110 mixes carbon dioxide gas supplied from the carbon dioxide gas cylinder 120 with clean water supplied from the water tank 70, thereby producing carbonated water. The carbonated water tank 110 may store the produced carbonated water.

In addition to the above-described carbon dioxide gas supply line 200, a clean water supply line 210 to receive clean water from the water tank 70 may be connected to the carbonated water tank 110. A carbonated water discharge line 230 to discharge the produced carbonated water into the dispensation space 91, and an exhaust line 250 to exhaust carbon dioxide gas remaining in the carbonated water tank 110, for supply of clean water to the carbonated water tank 110, may also be connected to the carbonated water tank 110.

A clean water supply valve 211 to open or close the clean water supply line 210 may be provided at the clean water supply line 210. The carbonated water discharge line 230 may be provided with a carbonated water discharge valve 231 to open or close the carbonated water discharge line 230, and a carbonated water regulator 800 to adjust the pressure of carbonated water discharged through the carbonated water discharge line 230. An exhaust valve 251 to open or close the exhaust line 250 may be provided at the exhaust line 250.

In this case, each of the clean water supply valve 211 and carbonated water discharge valve 231 may be a solenoid valve.

Meanwhile, the carbonated water tank 110 may be provided with a water level sensor 111 to measure the amount of clean water supplied to the carbonated water tank 110, and a temperature sensor 112 to measure the temperature of clean water supplied to the carbonated water tank 110 or the temperature of carbonated water produced in the carbonated water tank 110.

A relief valve 950 may also be provided at the carbonated water tank 110. When carbon dioxide gas of a high pressure exceeding a predetermined pressure is supplied to the carbonated water tank 110 due to malfunction of the carbon dioxide gas regulator 201, etc, the relief valve 950 discharges the carbon dioxide gas of the excessively high pressure.

The carbonated water tank 110 may be formed to have a predetermined size. For example, the carbonated water tank 110 may be formed to receive 1 l of carbonated water. The carbonated water tank 110 may be made of a stainless steel material in order to minimize the size of the carbonated water tank 110 while sustaining a high pressure and exhibiting corrosion resistance. The carbonated water tank 110 may be received in the first upper accommodation space 151 of the module case 140. The carbonated water tank 110 may be supported by a bottom support 155 and a guide 156 which are included in the module case 140.

Meanwhile, the above-described clean water supply valve 211 and carbonated water discharge valve 231 may constitute a valve assembly 130, together with a clean water discharge valve 221 provided at the clean water discharge line 220 to directly discharge clean water into the dispensation space 91. That is, the clean water supply valve 211, carbonated water discharge valve 231, and clean water discharge valve 221 may be integrated in the form of a single unit. In this case, the clean water discharge valve 221 may be implemented by a solenoid valve, as in the clean water supply valve 211 and carbonated water discharge valve 231.

The valve assembly 130 may include a first inlet port 130*a* connected to the water tank 70, and a second inlet port 130*b* connected to the carbonated water tank 110. The valve assembly 130 may also include a first outlet port 130*c* connected to the carbonated water tank 110, a second outlet port 130*d* connected to the dispensation space 91, to discharge clean water, and a third outlet port 130*e* connected to the dispensation space 91, to discharge carbonated water.

The clean water supply line 210 and clean water discharge line 220 may pass through the first inlet port 130*a*. Through the second inlet port 130*b*, the carbonated water discharge line 230 may pass. The clean water supply line 210 may pass through the first outlet port 130*c*. The clean water discharge line 220 may pass through the second outlet port 130*d*. Through the third outlet port 130*e*, the carbonated water discharge line 230 may pass.

Of course, the clean water supply valve 211, clean water discharge valve 221, and carbonated water discharge valve 231 are independently opened or closed. Accordingly, supply of clean water from the water tank 70 to the carbonated water tank 110 and discharge of clean water from the water tank 70 into the dispensation space 91 may be carried out in a simultaneous manner. In addition, supply of clean water from the water tank 70 to the carbonated water tank 110 and discharge of carbonated water from the carbonated water tank 110 into the dispensation space 91 may be carried out in a simultaneous manner.

Although the valve assembly 130 is constituted by the three independent valves 211, 221, and 231 as described above in the illustrated embodiment, it may be constituted by one three-way path change valve to selectively supply clean water from the water tank 70 to the carbonated water tank 110 or the dispensation space 91, and another three-way path change valve to supply clean water from the water tank 70 to the dispensation space 91 or to supply carbonated water from the carbonated water tank 110 to the dispensation space 91.

The above-described valve assembly 130 may be received in the second upper accommodation space 152 of the module case 140.

Meanwhile, the clean water discharge line 220 to directly discharge clean water from the water tank 70 into the dispensation space 91 and the carbonated water discharge line 230 to discharge carbonated water from the carbonated water tank 110 into the dispensation space 91 may be joined at a certain point, to form a common discharge line 240.

The clean water discharge line 200 and carbonated water discharge line 230 may be joined within the valve assembly 130 or at the second outlet port 130*d*. Accordingly, the clean water discharge line 200 and carbonated water discharge line 230 may be unified to be provided in the dispensation space 91 in the form of a single line without being individually provided. Of course, the clean water discharge line 200 and carbonated water discharge line 230 may individually extend to the dispensation space 91 without being unified.

A remaining water discharge prevention valve 241 may be provided at the common discharge line 240. The remaining water discharge prevention valve 241 opens or closes the common discharge line 240 in order to prevent clean water or carbonated water remaining in the common discharge line 240 from being discharged into the dispensation space 91 in closed states of the clean water discharge valve 221 and carbonated water discharge valve 231. The remaining water discharge prevention valve 241 may be disposed at an end of the common discharge line 240, if possible.

The module case 140 may include a back case 150 opened at one side thereof, and a cover 160 coupled to the opened side of the back case 150.

The module case 140 may be formed with at least one fitting groove 154 at a position corresponding to at least one fitting protrusion 25 formed at the back surface of the door 21. Accordingly, it may be possible to easily mount the module case 140 to the back surface of the door 21 by fitting the fitting protrusion 25 into the fitting groove 154. Of course, such a coupling structure is illustrative. It may be possible to detachably mount the module case 140 to the back surface of the door 21, using a thread fastening structure or a hook engagement structure, in place of the fitting structure.

In addition, the back case 150 and cover 160 may be formed with a fitting groove 158 and a fitting protrusion 162 at corresponding positions, respectively, and, as such, the cover 160 may be coupled to the back case 150. Of course, such a coupling structure is illustrative. It may be possible to detachably couple the back case 150 and cover 160, using various coupling structures.

Meanwhile, in a state in which the cover 160 is coupled to the back case 150, the carbon dioxide gas cylinder 120, carbonated water tank 110, and valve assembly 130 received in the module case 140 may be prevented from being exposed to the outside. Accordingly, the aesthetics of the door 21 may not be degraded.

Of course, a louver 161 may be formed at the cover 160, to communicate the interior of the module case 140 with the outside. Accordingly, even in a state in which the cover 160 is coupled to the back case 150, cold air in the storage chamber may be supplied to the carbonated water tank 110 within the module case 140 and, as such, carbonated water stored in the carbonated water tank 110 may be cooled to an appropriate temperature or may be kept at the appropriate temperature.

The cover 160 may be divided into a first cover 160*a* to open or close the upper accommodation spaces 151 and 152, in which the carbonated water tank 110 and valve assembly 130 are received, respectively, and a second cover 160*b* to open or close the lower accommodation space 153, in which the carbon dioxide gas cylinder 120 is received. The first cover 160*a* and second cover 160*b* may be independently opened or closed.

Accordingly, when the carbon dioxide gas cylinder 120 is replaced with a new one due to exhaustion of carbon dioxide gas thereof, the replacement may be achieved by separating only the second cover 160*b* without opening the first cover 160*a*. Thus, it may be possible to prevent cold air in the upper accommodation space 151 from being outwardly discharged during replacement of the carbon dioxide gas cylinder 120 because the first cover 160*a* is maintained in a closed state.

In other words, the carbonated water production module 100 in the refrigerator according to the illustrated embodiment may include a first module including the carbonated water tank 110 and the first accommodation space 151 to receive the carbonated water tank 110, and a second module including the carbon dioxide gas cylinder 120 and the second accommodation space 153 to receive the carbon dioxide gas cylinder 120.

In this case, the second module may be disposed beneath the first module. In addition, the second module may be disposed at one side of the ice guide passage 94 to guide ice from the icemaker 80 to the dispensation space 91.

The first module may also include the first cover 160*a* to open or close the first accommodation space 151. The second module may also include the second cover 160*b* opened or closed independently of the first cover 160*a*, to open or close the lower accommodation space 153.

Figure 6:
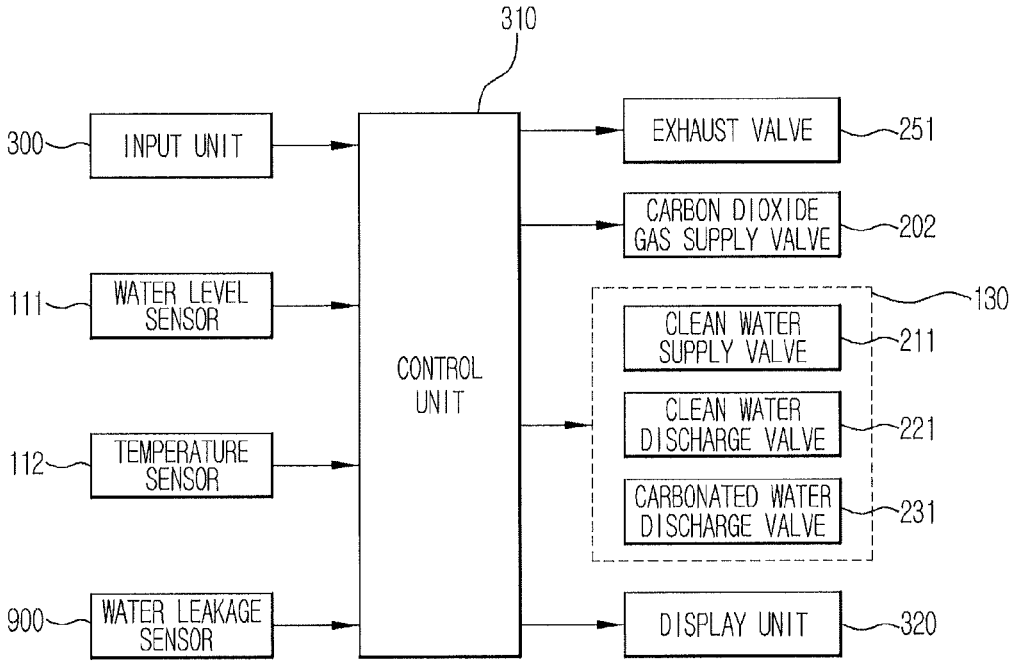
FIG. 6 is a block diagram explaining a control method of the refrigerator illustrated in FIG. 1.

FIG. 6 is a block diagram explaining a control method of the refrigerator illustrated in FIG. 1.

Hereinafter, carbonated water production and discharge procedures in the refrigerator according to an embodiment will be described with reference to FIGS. 5 and 6.

As illustrated in FIG. 6, the refrigerator according to the illustrated embodiment may further include an input unit 300 to input a command for discharge of carbonated water or discharge of clean water, and a display unit 320 to inform whether carbonated water has been produced, in addition to the above-described water level sensor 111, temperature sensor 112, exhaust valve 251, carbon dioxide gas supply valve 202, and the valve assembly 130 in which the clean water supply valve 211, clean water discharge valve 221, and carbonated water discharge valve 231 are integrally formed. The refrigerator may also include a water leakage sensor 900.

The refrigerator may further include a control unit 310 to control opening and closing operations of the exhaust valve 251 and carbon dioxide gas supply valve 202, opening and closing operations of the valve assembly 130, in which the clean water supply valve 211, clean water discharge valve 221, and carbonated water discharge valve 231 are integrally formed, and operation of the display unit 320, based on information received from the water level sensor 111, temperature sensor 112, water leakage sensor 900, and input unit 300.

Figure 7:
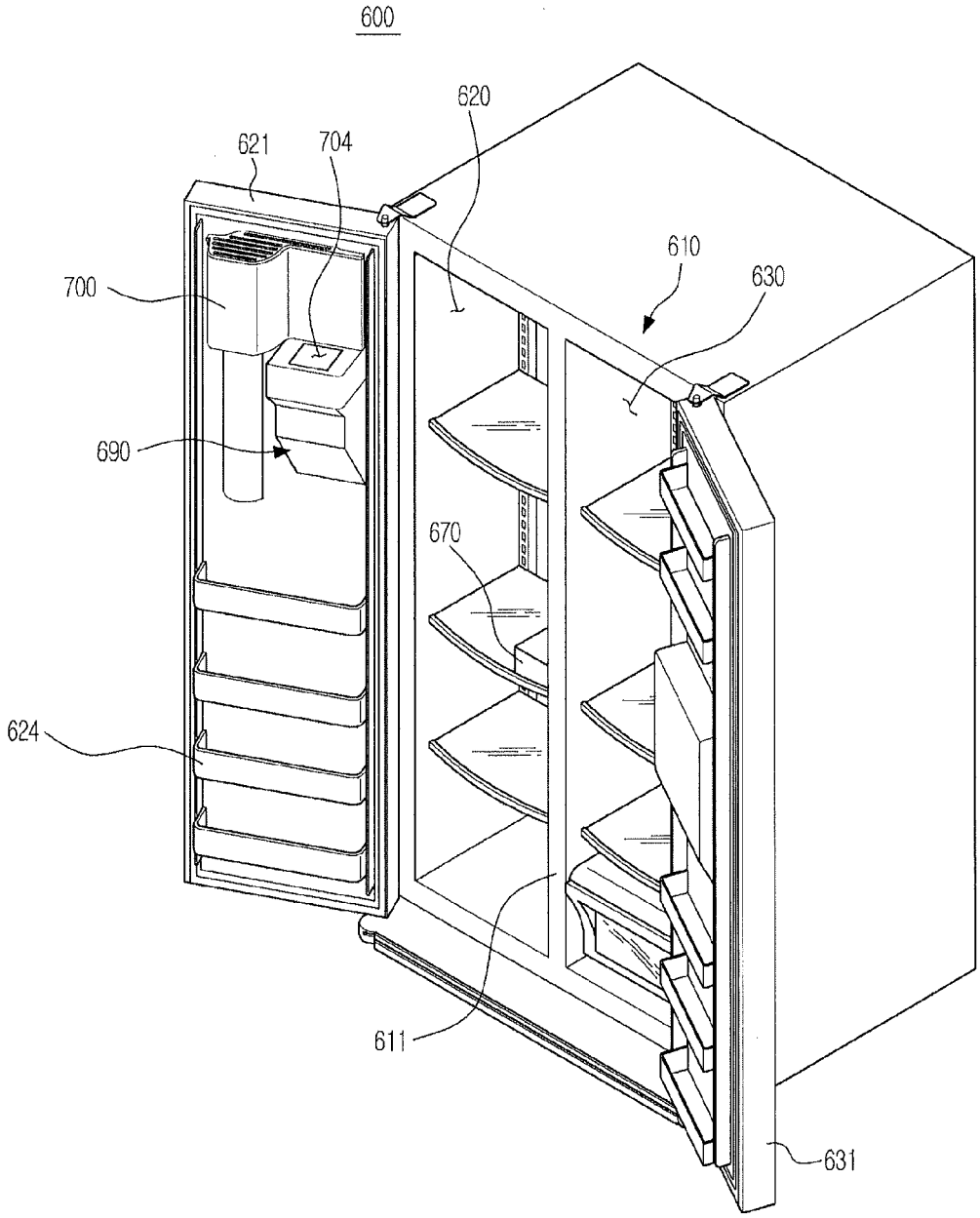
FIG. 7 is a perspective view illustrating an interior of a refrigerator according to one embodiment.

FIG. 7 is a perspective view illustrating an interior of a refrigerator according to another embodiment.

As illustrated in FIG. 7, the idea of the illustrated embodiment, for example, may be applied to a side-by-side (SBS) type refrigerator as well as the above-described French door refrigerator (FDR) type refrigerator or any type of appliance that supplies drinking water. The refrigerator which is designated by reference numeral "600" may include storage chambers 620 and 630 laterally divided from each other by a vertical barrier wall 611.

Each of the storage chambers 620 and 630 may be used as a refrigerating compartment or a freezing compartment. FIG. 7 illustrates an example in which the left storage chamber 620 is used as a refrigerating compartment, and the right storage chamber 630 is used as a freezing compartment. In the following description, the left storage chamber 620 will be referred to as a "refrigerating compartment 620", and the right storage chamber 630 will be referred to as a "freezing compartment 630".

Each of the refrigerating compartment 620 and freezing compartment 630 may be opened at a front side thereof. The front sides of the refrigerating compartment 620 and freezing compartment 630 may be opened or closed by a pair of pivotable doors 621 and 631, respectively. Door guards 624 capable of storing food may be provided at each of the doors 621 and 631.

A water tank 670 capable of storing water may be provided at the refrigerating compartment 620. Clean water stored in the water tank 670 may be naturally cooled by cold air present in the refrigerating compartment 620. A dispenser 690 may be provided at the refrigerating compartment doors 21 and 22, for example, the refrigerating compartment door 621, to allow the user to retrieve water or ice stored in the refrigerator from the outside of the refrigerator without opening the refrigerating compartment door 621. An ice guide passage 704 may be provided at the dispenser 690, to guide ice.

A carbonated water production module 700 having the same structure as that of the refrigerator according to the previous embodiment of the present invention may be mounted to the back surface of the refrigerating compartment door 621.

Figure 8A:
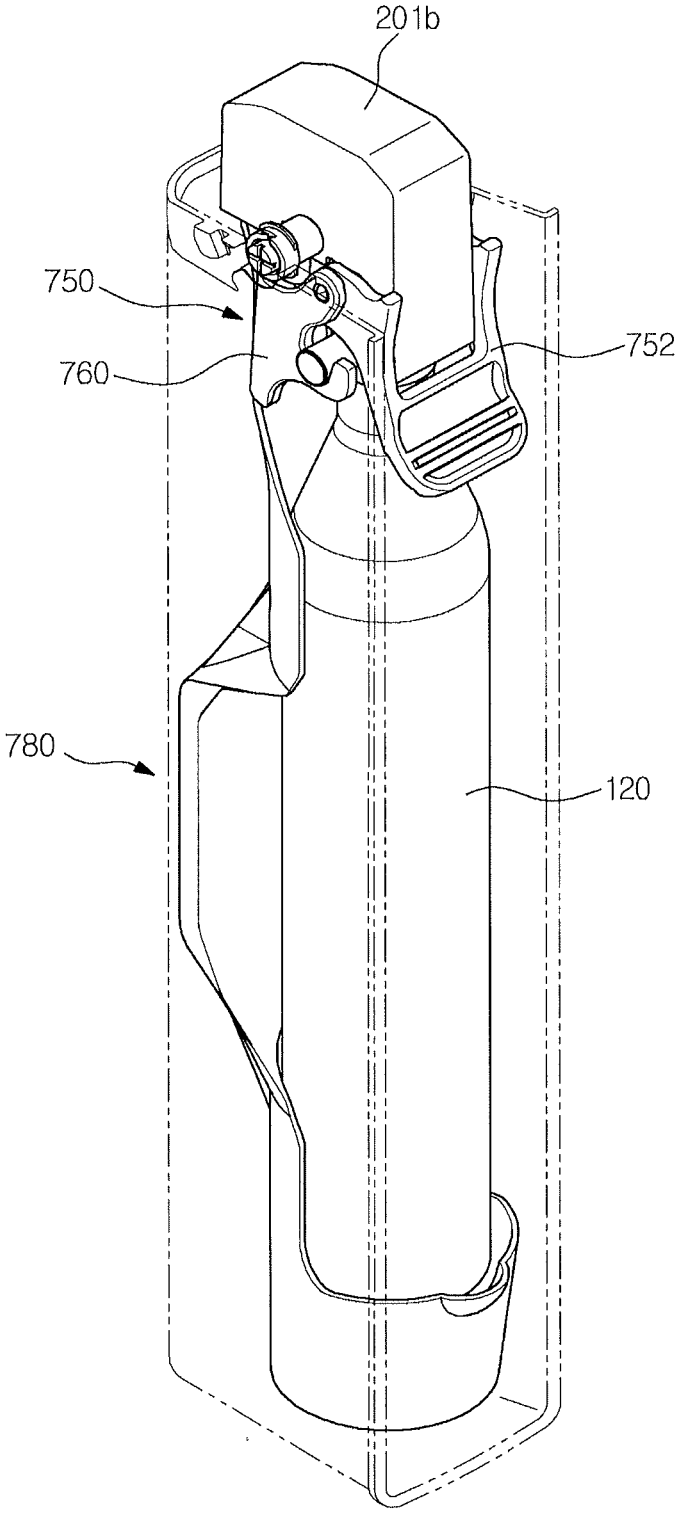
FIG. 8A is a perspective view illustrating the carbon dioxide gas cylinder along with a safety device included in the refrigerator in accordance with an embodiment.
Figure 8B:
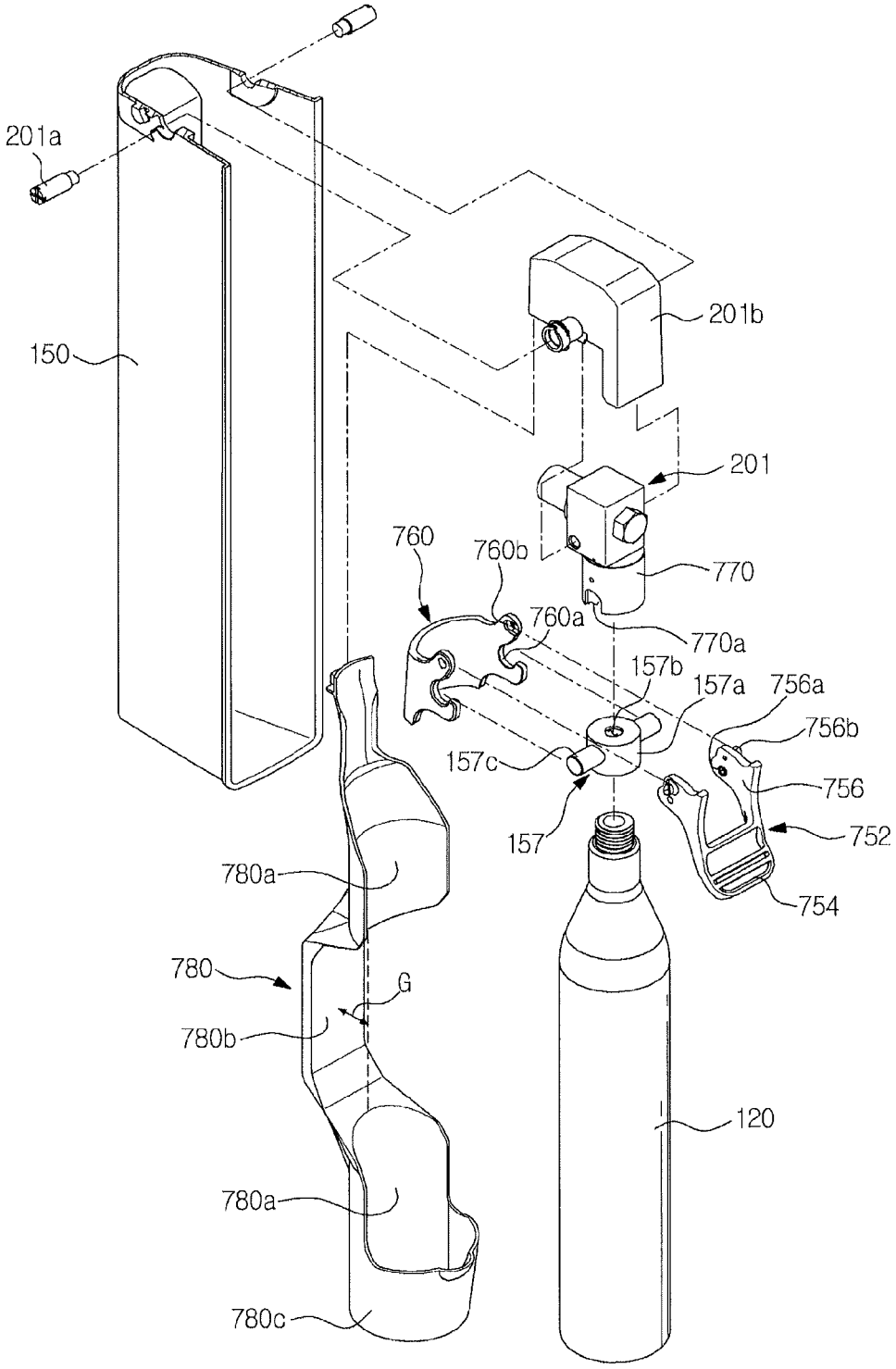
FIG. 8B is an exploded perspective view illustrating the carbon dioxide gas cylinder and safety device according to the illustrated embodiment.
Figure 8C:
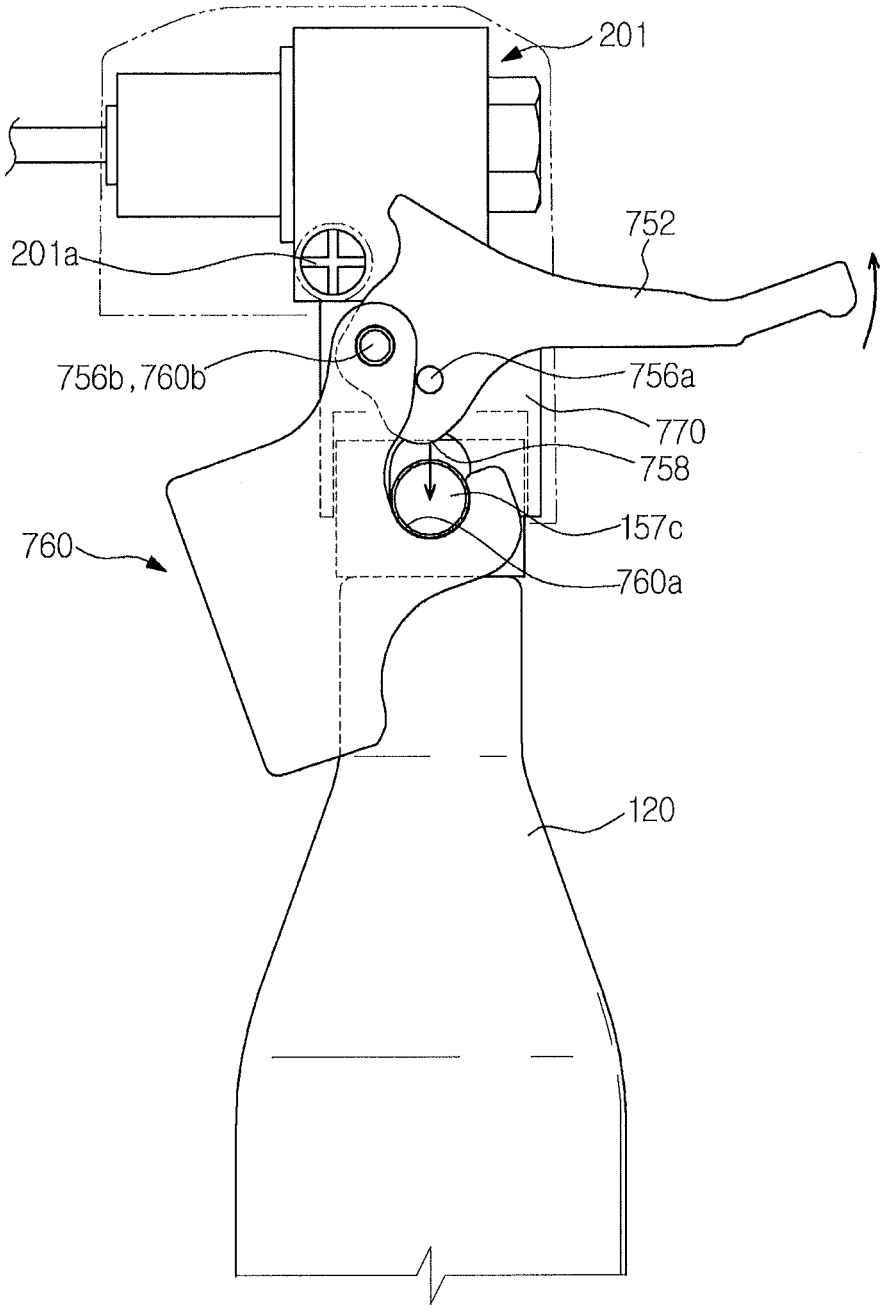
FIGS. 8C and 8D are views illustrating operations of the safety device according to the illustrated embodiment.
Figure 8D:
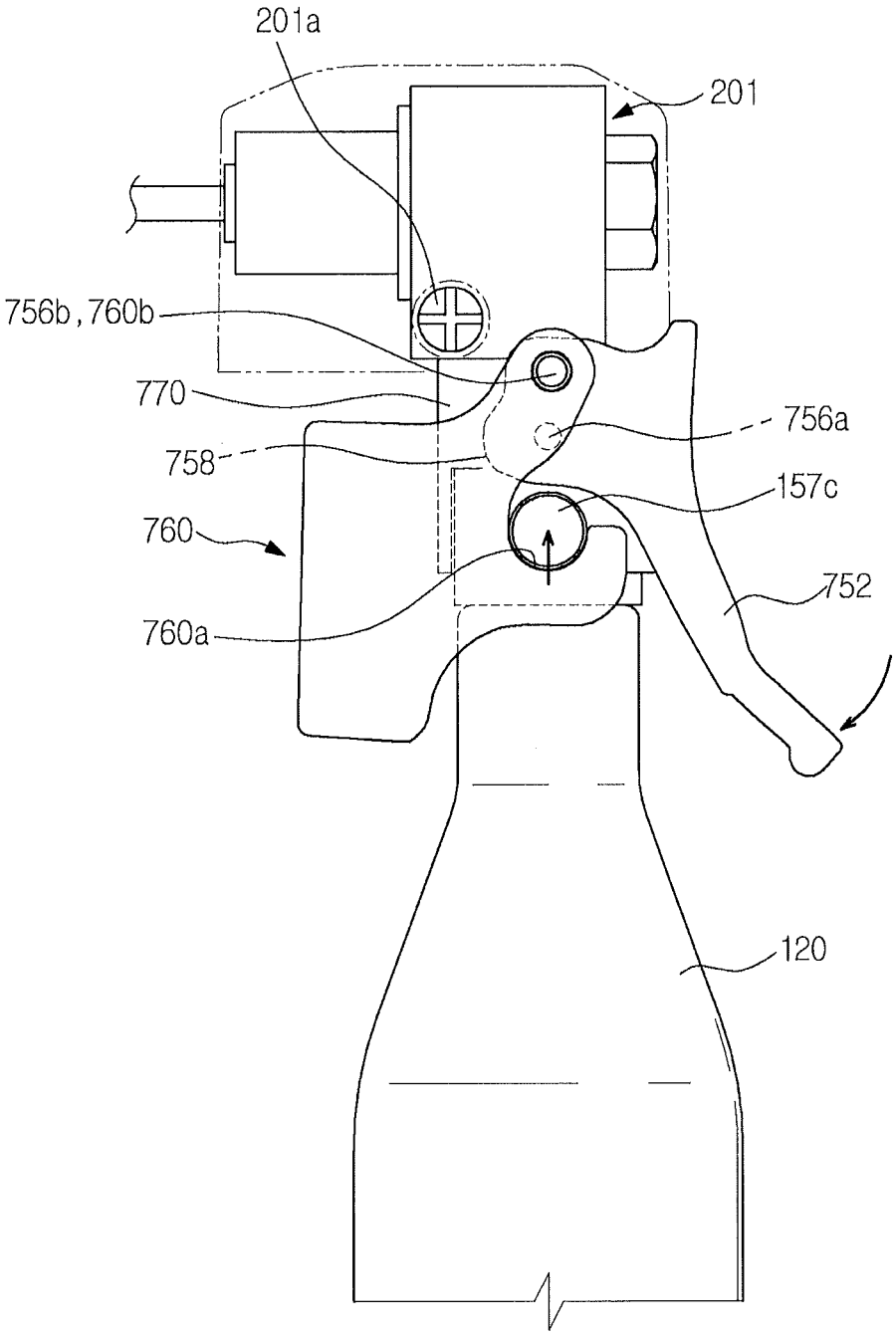
Figure 8E:
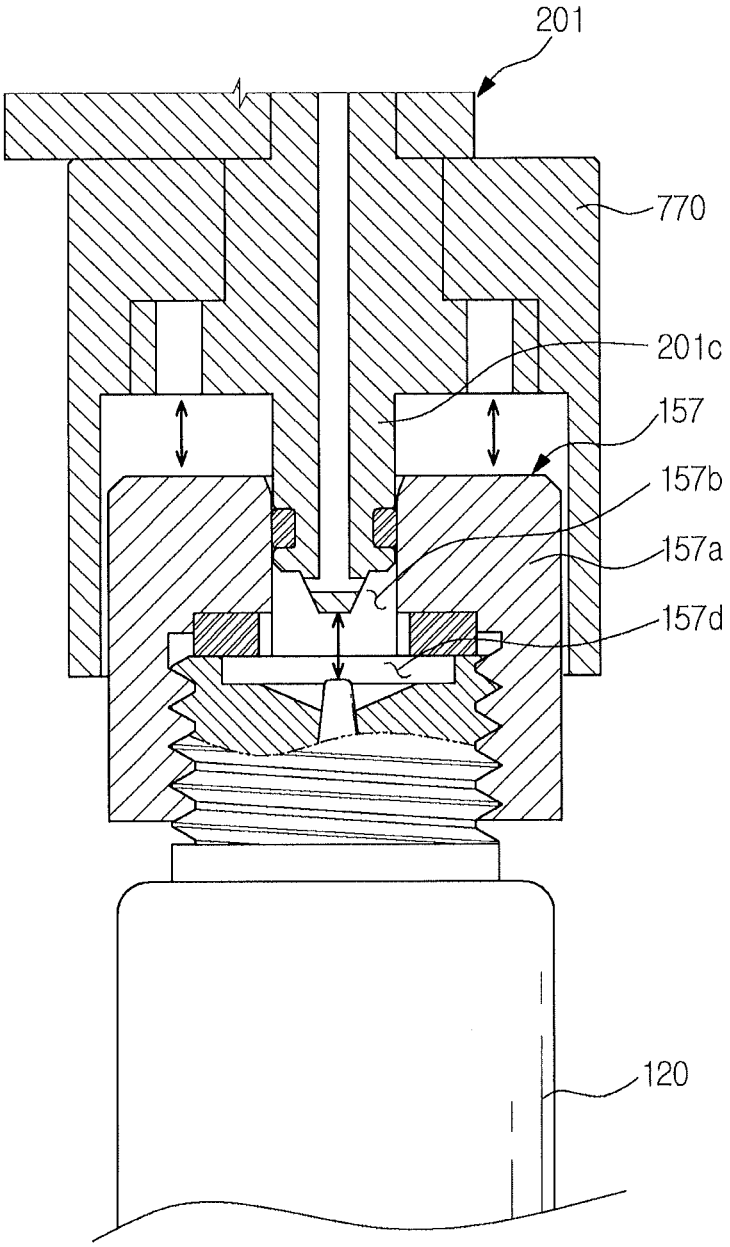
FIG. 8E is a sectional view illustrating coupling of the carbon dioxide gas cylinder to a gas regulator according to an embodiment.
Figure 8F:
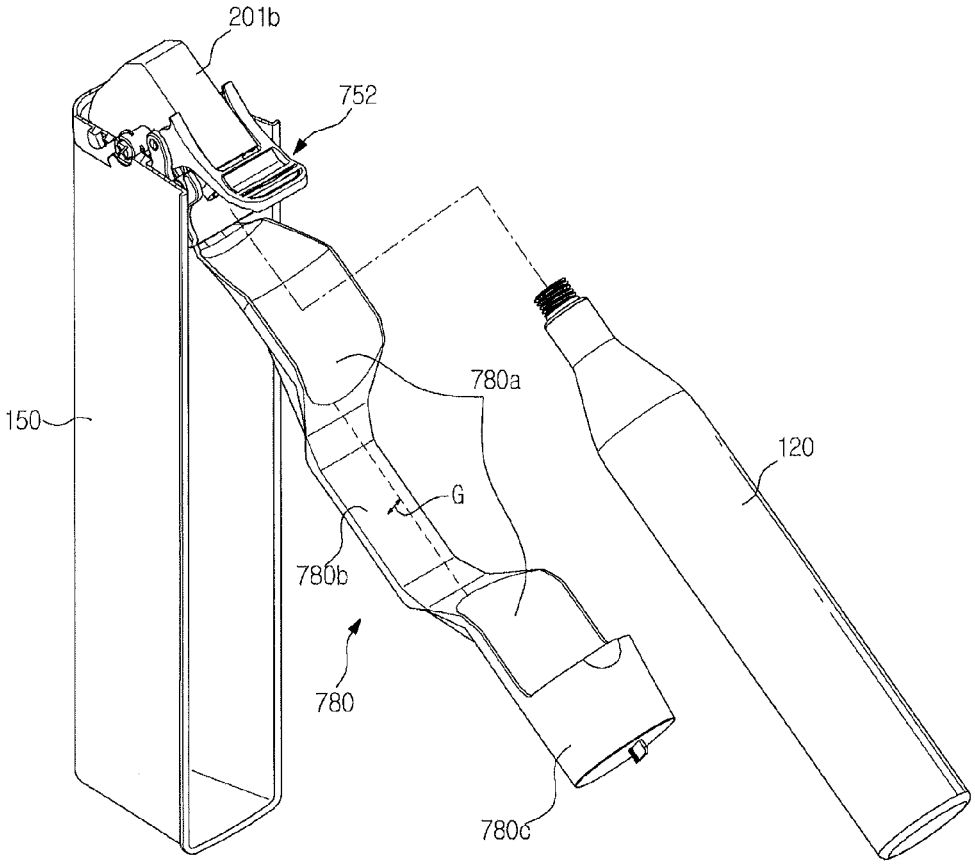
FIG. 8F is a perspective view illustrating coupling of the carbon dioxide gas cylinder to the gas regulator.

FIG. 8A is a perspective view illustrating the carbon dioxide gas cylinder along with a safety device included in the refrigerator in accordance with an embodiment. FIG. 8B is an exploded perspective view illustrating the carbon dioxide gas cylinder and safety device according to the illustrated embodiment. FIGS. 8C and 8D are views illustrating operations of the safety device according to the illustrated embodiment. FIG. 8E is a sectional view illustrating coupling of the carbon dioxide gas cylinder to a gas regulator according to an embodiment FIG. 8F is a perspective view illustrating coupling of the carbon dioxide gas cylinder to the gas regulator.

The carbon dioxide gas cylinder 120 is disposed in the lower accommodation space 153 of the carbonated water production module 100. When the carbon dioxide gas cylinder 120 is connected to the cylinder connector 157, carbon dioxide gas is supplied to the carbonated water tank 110 in a pressure-reduced state via the gas regulator 201.

The safety device which is designated by reference numeral "750" includes a safety lever 752 pivotably mounted to the cylinder connector 157 coupled to one side of the carbon dioxide gas cylinder 120, and a safety lever 752 pivotably mounted to opposite sides of the gas regulator 201, to selectively move the carbon dioxide gas cylinder 120 toward or away from the gas regulator 201 in accordance with pivotal movement thereof.

The cylinder connector 157 has a configuration to allow the carbon dioxide gas cylinder 120 to be coupled, at one side thereof, to the cylinder connector 157. For this configuration, the cylinder connector 157 includes a cylindrical cylinder connector body 157*a* opened at one side thereof, and a cylinder connector hole 157*b* provided at the other side of the cylinder connector body 157*a*, namely, a closed side of the cylinder connector body 157*a* opposite to the opened side, to allow a push rod 201*c* to extend therethrough. The push rod 201*c* is provided at the gas regulator 201, to guide carbon dioxide gas from the carbon dioxide gas cylinder 120.

The cylinder connector body 157*a* has a configuration defining an appearance of the cylinder connector 157. That is, the cylinder connector body 157*a* has a cylindrical shape opened at one side thereof. Cylinder connector moving pins 157*c* are provided at a side portion of the cylinder connector body 157*a*, namely, a cylindrical portion of the cylinder connector body 157*a*. The cylinder connector moving pins 157*c* are protruded from opposite sides of the cylindrical portion of the cylinder connector body 157*a*, respectively. The cylinder connector moving pins 157*c* are moved by the safety lever 752 and a safety lever holder 760, to couple or separate the carbon dioxide gas cylinder 120 to or from the gas regulator 201.

An outlet portion of the carbon dioxide gas cylinder 120 is fitted in a gas cylinder coupling portion 157*d* formed at the opened side of the cylinder connector body 157*a*. Threads are formed at an inner peripheral surface of the gas cylinder coupling portion 157*d*, namely, an inner surface of the cylindrical portion of the cylinder connector body 157*a*. On the other hand, threads are formed at an outer peripheral surface of the outlet portion of the carbon dioxide cylinder 120 which has a cylindrical shape. Accordingly, it may be possible to threadedly couple the carbon dioxide gas cylinder 120 to the cylinder connector 157 after bring the carbon dioxide gas cylinder 120 into contact with the cylinder connector 157, and then rotating the carbon dioxide gas cylinder 120.

The cylinder connector hole 157*b* is provided at the other side of the cylinder connector 157 corresponding to the outlet portion of the carbon dioxide gas cylinder 120. The cylinder connector hole 157*b* allows the push rod 201*c*, which is provided at the gas regulator 201 while having a tubular shape to guide carbon dioxide gas from the carbon dioxide gas cylinder 120, to be inserted into the outlet portion of the carbon dioxide gas cylinder 120 after passing through the cylinder connector hole 157*b* provided at the other side of the cylinder connector body 157*a*.

As illustrated in FIG. 8E, the cylinder connector 157 and gas regulator 201 are kept spaced apart from each other by a predetermined distance, even in a coupled state of the carbon dioxide gas cylinder 120. As a result, even when the carbon dioxide gas cylinder 120 is coupled to the cylinder connector 157, it may be possible to prevent the push rod 201*c* from being coupled to an outlet of the carbon dioxide gas cylinder 120 without operation of the safety device 750. The push rod 201*c* comes into contact with the outlet of the carbon dioxide gas cylinder 120, to be coupled to each other, only when the safety device 750 operates. The predetermined distance is 5 mm.

The safety lever 752 includes a lever portion 754 to receive force, and lever legs 756 each having a pivot pin hole 756*a*. The safety lever 752 may be pivotably coupled to the gas regulator 201 by a pivot pin extending through the pivot pin holes 756*a* of the lever legs 756 and a hole formed through the gas regulator 201. The safety lever 752 also includes cylinder connector pushing portions 758 provided at respective lever legs 756, to push respective cylinder connector moving pins 157*c*. The safety lever 752 is disposed at the front side of the gas regulator 201.

The lever portion 754 is vertically pivotable about the pivot pin extending through the pivot pin holes 756*a* provided at the lever legs 756. In accordance with vertical pivotal movement of the lever portion 754, the cylinder connector 157 is coupled to or separated from the gas regulator 201.

The lever legs 756 extend from opposite lateral ends of the lever portion 754 in a bent state, respectively. As described above, the lever legs 756 have respective pivot pin holes 756*a* and, as such, the lever portion 754 is pivotable with respect to the lateral sides of the gas regulator 201.

The cylinder connector pushing portions 758 are protruded from respective lever legs 756. The cylinder connector pushing portions 758 have a curvature about the pivot pin holes 756*a* different from that of the lever legs 756. The cylinder connector pushing portions 758 support top portions of the cylinder connector moving pins 157*c*, respectively. Through such a configuration, the cylinder connector pushing portions 758 are directed to the cylinder connector moving pins 157*c* during upward movement of the lever portion 754 while being directed to a back side of the gas regulator 201 during downward movement of the lever portion 754. In detail, when the lever portion 754 moves downward to bring the cylinder connector 157 into close contact with the gas regulator 201, the cylinder connector pushing portions 758 do not interfere with the cylinder connector moving pins 157*c* because they are directed to the back side of the gas regulator 201. However, when the lever portion 754 moves upward to cause the cylinder connector 157 to be spaced apart from the gas regulator 201, the cylinder connector pushing portions 758 move the cylinder connector 157 downward because it is directed to the cylinder connector moving pins 157*c* and, as such, the cylinder connector 157 is spaced apart from the gas regulator 201.

The safety device 750 further includes the safety lever holder 760. The safety lever holder converts rotational movement of the safety lever 752 into extension or retraction movement of the cylinder connector 157.

The safety lever holder 760 is disposed at the back side of the gas regulator 201. The safety lever holder 760 includes holder coupling holes to be coupled with the safety lever 752, and cylinder connector seating grooves 760*a*, in which respective cylinder connector moving pins 157*c* are seated.

Safety lever coupling pins 756*b* are provided at respective lever legs 756 of the safety lever 752, for coupling of the safety lever holder 760 to the safety lever 752. The safety lever coupling pins 756*b* are spaced apart from respective pivot pin holes 756*a*. The safety lever coupling pins 756*b* are disposed at positions opposing the lever portion 754 with respect to respective pivot pin holes 756*a*. Accordingly, the safety lever holder 760 is pivotally moved about the pivot pin holes 756*a* in accordance with pivotal movement of the safety lever 752. Holder coupling holes 760*b* are provided at the safety lever holder 760, to be coupled with respective safety lever coupling pins 756*b*. As the holder coupling holes 760*b* of the safety lever holder 760 are coupled with respective safety lever coupling pins 756*b*, pivotal movement of the safety lever 752 is transmitted to the safety lever holder 760. In detail, when the lever portion 754 performs upward pivotal movement about the pivot pin holes 756*a*, the safety lever coupling pins 756*b* and holder coupling holes 760*b* are moved upward, thereby causing the safety lever holder 760 to be moved upward. On the other hand, when the lever portion 754 performs downward pivotal movement about the pivot pin holes 756*a*, the safety lever coupling pins 756*b* and holder coupling holes 760*b* are moved downward, thereby causing the safety lever holder 760 to be moved downward.

As described above, the cylinder connector seating grooves 760*a* are provided at the safety lever holder 760 and, as such, the cylinder connector moving pins 157*c* are seated in respective cylinder connector seating grooves 760*a*. Each cylinder connector seating groove 760*a* is formed at the safety lever holder 760 in a concave shape. Each cylinder connector seating groove 760*a* supports a bottom side of the cylinder connector moving pin 157*c* seated therein. Thus, the cylinder connector moving pins 157*c* are moved upward in accordance with upward movement of the safety lever holder 760.

The safety device 750 also includes a cylinder connector guide 770 disposed to enclose the cylinder connector 157. The cylinder connector guide 770 is opened at one side thereof in order to enclose the cylinder connector 157. Cylinder connector guide grooves 770*a* are provided at opposite sides of the cylinder connector guide 770, to guide upward and downward movements of the cylinder connector moving pins 157*c*.

Gas regulator pivot pins 201*a* are provided at opposite sides of the gas regulator 201, to pivotally move the gas regulator 201. Through such a configuration, the push rod of the carbon dioxide gas cylinder 120 may be forwardly directed during replacement of the carbon dioxide gas cylinder 120 and, as such, replacement of the carbon dioxide gas cylinder 120 may be easily achieved. The gas regulator pivot pins 201*a* may protrude from opposite side surfaces of the gas regulator 201. Alternatively, separate pivot pins may be provided as the gas regulator pivot pins 201*a*. In this case, the gas regulator pivot pins 201*a* may be coupled to the gas regulator 201.

The gas regulator 201 is enclosed, at an outer surface thereof, by a gas regulator case 201*b*. Accordingly, it may be possible to protect the configuration of the gas regulator 201 from an external environment.

A gas cylinder guide 780 to guide the cylindrical carbon dioxide gas cylinder 120 is provided at one side of the carbon dioxide gas cylinder 120. Although there is no limitation as to the position of the gas cylinder guide 780, the gas cylinder guide 780 is disposed at the back side of the carbon dioxide gas cylinder 120, taking into consideration aesthetics and space utilization.

The gas cylinder guide 780 includes a cylinder contact portion 780*a* to contact at least a side surface of the cylindrical carbon dioxide gas cylinder 120 in a longitudinal direction of the cylindrical carbon dioxide gas cylinder 120, a cylinder spacing portion 780*b* provided at the cylinder contact portion 780*a*, to be spaced apart from the carbon dioxide gas cylinder 120 by a predetermined spacing, and a cylinder seating portion 780*c* in which a lower portion of the carbon dioxide gas cylinder 120 is seated.

The cylinder contact portion 780*a* contacts one side of the carbon dioxide gas cylinder 120, to prevent the carbon dioxide gas cylinder 120 from vibrating or moving. One end of the cylinder contact portion 780*a* is coupled to the gas regulator 201 or gas regulator case 201*b*. When the gas regulator 201 pivots about the gas regulator pivot pins 201*a*, the cylinder contact portion 780*a* is pivoted along with the gas regulator 201.

The cylinder spacing portion 780*b* is formed at an intermediate region of the cylinder contact portion 780*a* so as to outwardly protrude from the cylinder contact portion 780*a*, to be spaced apart from the carbon dioxide gas cylinder 120 by the predetermined spacing. The predetermined spacing provides a space into which the hand of the user may be inserted when the user rotates the carbon dioxide gas cylinder 120 while grasping the carbon dioxide gas cylinder 120 upon coupling or separation of the carbon dioxide gas cylinder 120 to or from the cylinder connector 157. There is no limitation as to the predetermined spacing, so long as the predetermined spacing provides a space into which the hand of the user may be inserted when the user grasps the carbon dioxide gas cylinder 120.

The cylinder seating portion 780*c* is configured to receive the lower portion of the carbon dioxide gas cylinder 120. Since the carbon dioxide gas cylinder 120 has a cylindrical shape, the cylinder seating portion 780*c* also has a cylindrical shape opened at one side thereof.

Hereinafter, operation of the safety device 750 according to the above-described configuration will be described.

Upon replacement of the carbon dioxide gas cylinder 120, the gas regulator 201 and gas cylinder guide 780 are pivoted about the gas regulator pivot pins 201*a*, to be forwardly directed, as illustrated in FIG. 8F.

Thereafter, the carbon dioxide gas cylinder 120 is coupled to the cylinder connector 157 by threadedly coupling the threads provided at the outer peripheral surface of the outlet portion of the carbon dioxide gas cylinder 120 to the threads provided at the inner peripheral surface of the cylinder connector 157.

Subsequently, the lever portion 754 of the safety lever 752 is moved downward, as illustrated in FIG. 8D. In accordance with the downward movement of the lever portion 754, the safety lever 752 is pivoted about the pivot pin mounted in the pivot pin holes 756*a*. As a result, the safety lever coupling pins 756*b* and holder coupling holes 760*b* are moved upward, thereby causing the safety lever holder 760 to be moved upward.

The cylinder connector moving pins 157*c* of the cylinder connector 157 seated in the cylinder connector seating grooves 760*a* of the safety lever holder 760 are also moved upward. As a result, the cylinder connector 157 comes into close contact with the gas regulator 201 and, as such, the carbon dioxide gas cylinder 120 and gas regulator 201 are coupled to each other.

Upon separating the carbon dioxide gas cylinder 120 and gas regulator 201 from each other, the lever portion 754 of the safety lever 752 is moved upward, as illustrated in FIG. 8C. In this case, the safety lever 752 is pivoted about the pivot pin mounted in the pivot pin holes 756*a*. As a result, the safety lever coupling pins 756*b* and holder coupling holes 760*b* are moved downward, thereby causing the safety lever holder 760 to be moved downward.

In this case, the cylinder connector pushing portions 758 provided at respective lever legs 756 of the safety lever 752 is pivoted, thereby pushing the cylinder connector moving pins 157*c*. As a result, the cylinder connector moving pins 157*c* are moved downward and, as such, the cylinder connector 157 is spaced away from the gas regulator 201. Thus, the carbon dioxide gas cylinder 120 is separated from the gas regulator 201.

Figure 9A:
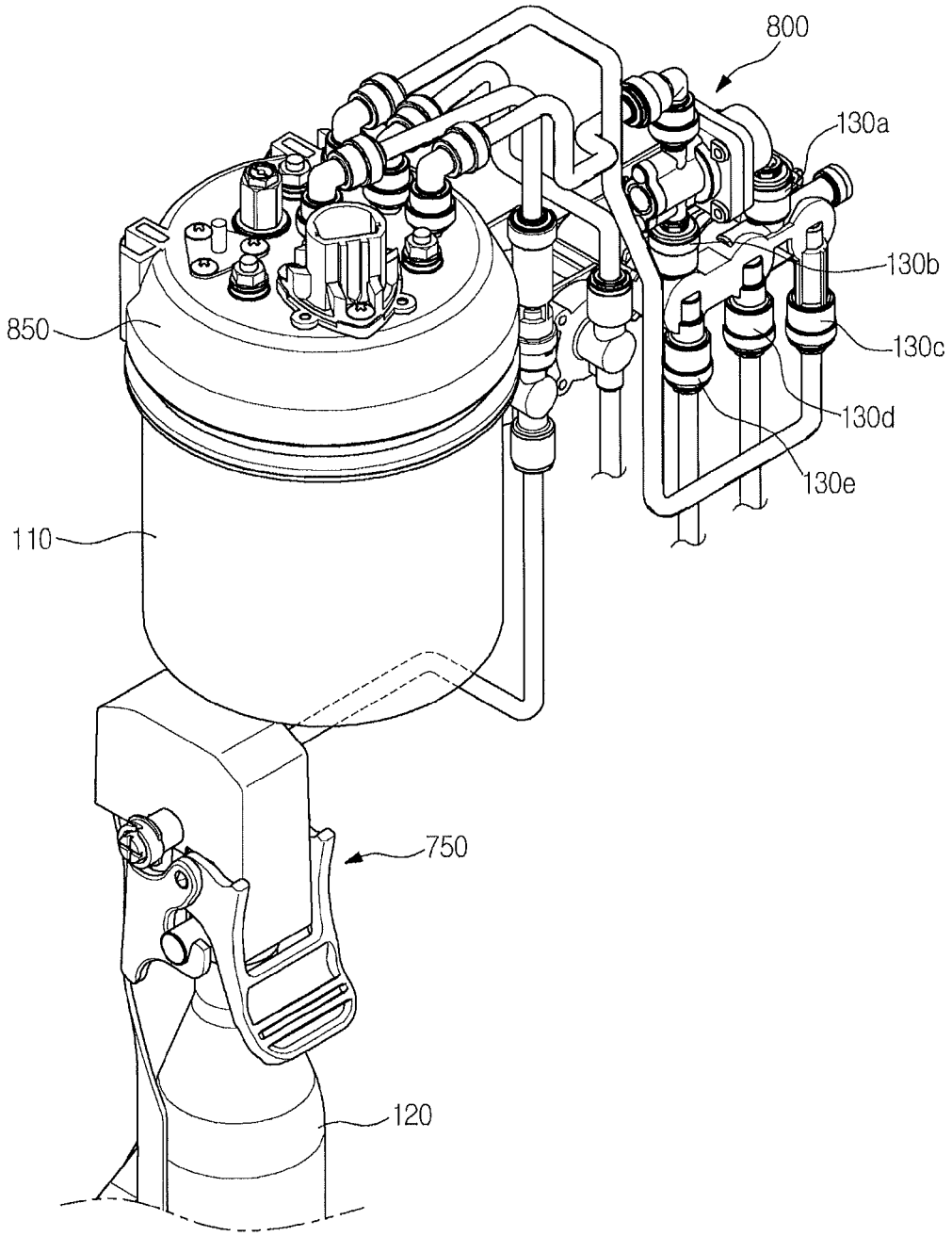
FIG. 9A is a perspective view illustrating an arrangement of the carbonated water regulator according to an embodiment.
Figure 9B:
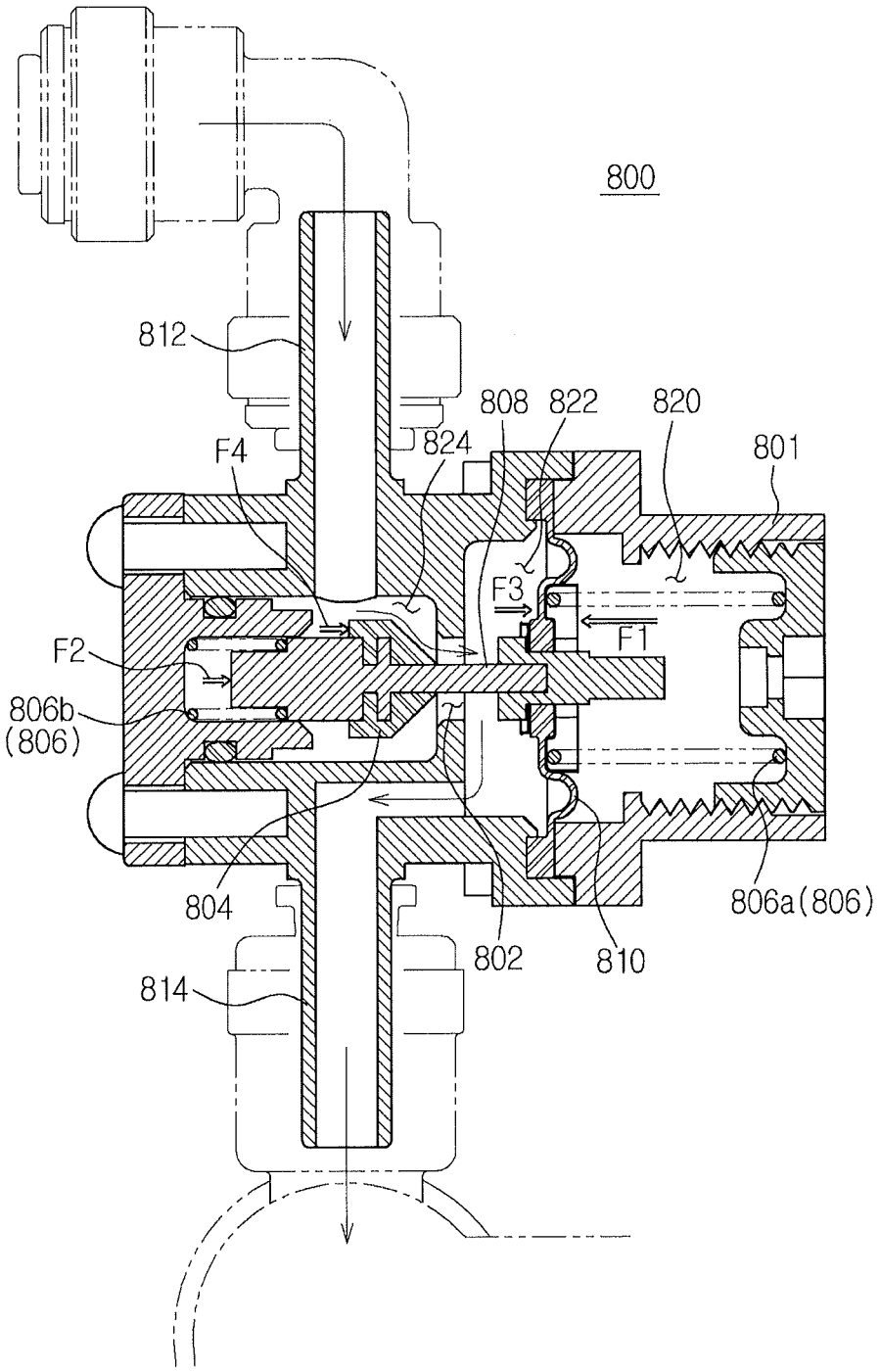
FIGS. 9B and 9C are sectional views illustrating operations of the carbonated water regulator according to the illustrated embodiment.
Figure 9C:
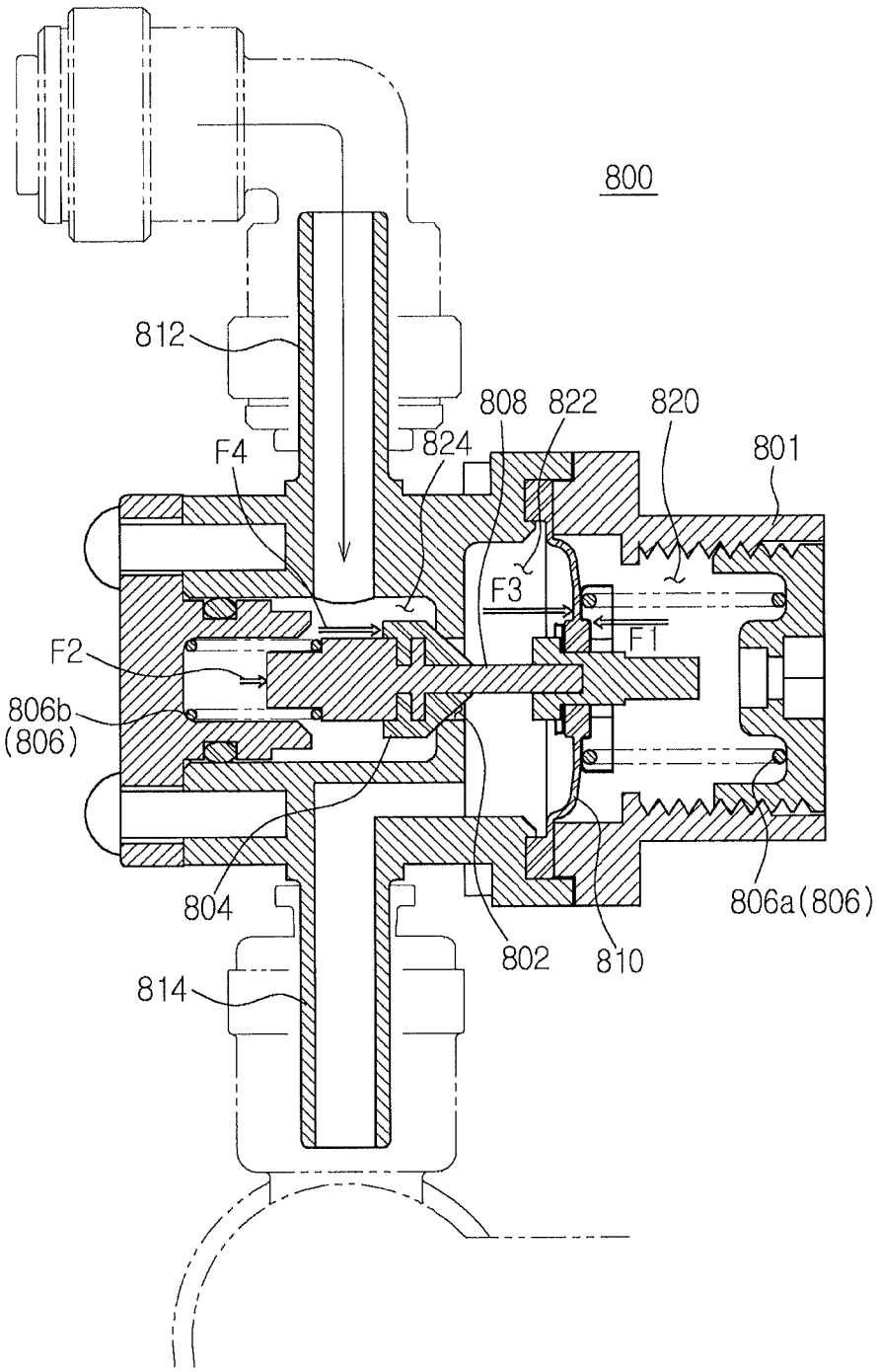

FIG. 9A is a perspective view illustrating an arrangement of the carbonated water regulator according to an embodiment. FIGS. 9B and 9C are sectional views illustrating operations of the carbonated water regulator according to the illustrated embodiment.

Clean water from the water tank 70 is supplied to the carbonated water tank 110 via the clean water supply line 210. When a predetermined amount of clean water is supplied, high-pressure carbon dioxide gas from the carbon dioxide gas cylinder 120 is introduced into the carbonated water tank 110, to produce carbonated water. The produced carbonated water is then forcibly discharged into the dispensation space 91 via the carbonated water discharge line 230 by the pressure of high-pressure carbon dioxide gas in the carbonated water tank 110.

The high-pressure carbon dioxide gas stored in the carbon dioxide gas cylinder 120 is maintained at a pressure of about 45 to 60 bars, and is supplied to the carbonated water tank 110 at a pressure of 10 bars after passing through the gas regulator 201. Carbonated water from the carbonated water tank 110 is forcibly discharged by the pressure of high-pressure carbon dioxide gas present within the carbonated water tank 110. Since carbonated water from the carbonated water tank 110 is discharged at a pressure of about 5 to 8 bars, frying of carbonated water may occur during dispensation of the carbonated water due to the pressure of carbon dioxide gas.

The carbonated water regulator 800 is a configuration to control carbonated water from the carbonated water tank 110 to be discharged at a predetermined pressure.

The carbonated water regulator 800 is provided at the carbonated water discharge line extending from the carbonated water tank 110 to the dispensation space 91.

In detail, the carbonated water regulator 800 is provided at the carbonated water discharge line which includes the carbonated water discharge line 230, the clean water discharge line 220, and the valve assembly 130 to open or close the clean water supply line 210, to connect the carbonated water tank 110 to the dispensation space 91.

As described above, the valve assembly 130 includes the first inlet port 130*a* connected to the water tank 70, the second inlet port 130*b* connected to the carbonated water tank 110, the first outlet port 130*c* connected to the carbonated water tank 110, for supply of clean water, the second outlet port 130*d* connected to the dispensation space 91, to discharge clean water, and the third outlet port 130*e* connected to the dispensation space 91, to discharge carbonated water. The carbonated water regulator 800 is provided at the carbonated water discharge line 230 which passing through the second inlet port 130*b* and third outlet portion 130*e* of the valve assembly 130 while extending from the carbonated water tank 110.

Through the above-described configuration, carbonated water discharged from the carbonated water tank 110 completely passes through the carbonated water regulator 800.

As carbonated water passes through the carbonated water regulator 800, it may be discharged through the third outlet portion 130*e* after being maintained at a predetermined pressure or below.

The carbonated water regulator 800 includes a regulator body 801 to define the appearance of the carbonated water regulator 800, a static pressure hole 802 to allow carbonated water to flow through the carbonated water regulator body 801, and an opening/closing member 804 to open or close at least a portion of the static pressure hole 802.

The regulator body 801, which defines the appearance of the carbonated water regulator 800, includes a carbonated water inlet 812 arranged at one side of the regulator body 801, to receive carbonated water, and a carbonated water outlet 814 arranged at the other side of the regulator body 801, to allow carbonated water to be discharged from the regulator body 801 after passing through the regulator body 801.

The static pressure hole 802 is provided at an inside of the regulator body 801, to be opened or closed in accordance with movement of the opening/closing member 804. The static pressure hole 802 is arranged in a flow path of carbonated water defined in the regulator body 801.

The static pressure hole 802 has a circular shape, and the opening/closing member 804 has a conical shape having a circular cross-section. Accordingly, the area occupied by the opening/closing member 804 in the static pressure hole 802 is varied in accordance with movement of the opening/closing member 804 through the static pressure hole 802. Thus, it may be possible to adjust an amount of carbonated water passing through the static pressure hole 802.

The opening/closing member 804 has a rod-shaped body, and an end having a conical shape. In the opening/closing member 804, the longitudinal cross-section of the end is greater than that of the body. The body is supported by regulator elastic members 806 and, as such, the opening/closing member 804 is movable in an extension or retraction direction by tensions of the regulator elastic members 806.

The carbonated water regulator 800 further includes at least one regulator elastic member 806 which may be tensed in accordance with pressure of carbonated water, to move the opening/closing member 804 in an extension or retraction direction.

In the illustrated embodiment, the at least one regulator elastic member 806 includes first and second regulator elastic members 806*a* and 806*b* disposed at opposite sides of the static pressure hole 802 while being connected by a balance rod 808. The first regulator elastic member 806*a* moves the balance rod 808 in accordance with a pressure of carbonated water at one side of the static pressure hole 802, whereas the second regulator elastic member 806*b* moves the balance rod 808 in accordance with a pressure of carbonated water at the other side of the static pressure hole 802.

A bellows 810 having elasticity is disposed over the static pressure hole 802. The first regulator elastic member 806*a* is disposed over the bellows 810 while being in contact with the bellows 810. Beneath the static pressure hole 802, the opening/closing member 804 and the second regulator elastic member 806*b* are disposed. As described above, the opening/closing member 804 functions to open or close at least a portion of the static pressure hole 802 in accordance with extension or retraction movement thereof. The second regulator elastic member 806*b* is provided at the body of the opening/closing member 804, to move the opening/closing member 804 in an extension or retraction direction.

The bellows 810 is coupled with the regulator body 801*b* while extending in a direction perpendicular to the longitudinal direction of the first regulator elastic member 806*a*. The bellows 801 prevents carbonated water from flowing toward the first regulator elastic member 806*a* while transmitting the pressure of carbonated water to the first regulator elastic member 806*a*.

The balance rod 808 contacts the bellows 810 at one end thereof while contacting the end of the opening/closing member 804 at the other end thereof. The balance rod 808 extends through a hollow portion of the static pressure hole 802.

Through the above-described configuration, carbonated water is introduced through the inlet of the carbonated water regulator 800, passes along the opening/closing member 804, and then contacts the bellows 810 after passing through the static pressure hole 802 and, as such, has influence on the bellows 810. Thereafter, the carbonated water is discharged through the outlet of the carbonated water regulator 800.

When the configuration of the carbonated water regulator 800 is viewed from a different standpoint, the carbonated water regulator 800 includes a first space 820 defined within the regulator body 801 by an inner surface of the regulator body 801 and the bellows 810 which has elasticity, a second space 822 partitioned from the first space 820 by the bellows 810, and a third space 824 partitioned from the second space 822 by the static pressure hole 802.

The first space 820 is provided with the first regulator elastic member 806*a* disposed within the first space 820. The first space 820 is divided from the second space 822 by the bellows 810, which has elasticity.

The second space 822 communicates with the carbonated water outlet 814, form which carbonated water is discharged. The second space 822 is divided from the third space 824 at opposite sides of the static pressure hole 802.

The third space 824 communicates with the carbonated water inlet 812, into which carbonated water is introduced. The third space 824 is provided with the second regulator elastic member 806*b* and opening/closing member 804.

Hereinafter, operation of the carbonated water regulator 800 having the above-described configuration will be described.

Carbonated water produced in the carbonated water tank 110 is forcibly discharged into the carbonated water discharge line 230 by the pressure of high-pressure carbon dioxide gas within the carbonated water tank 110.

Carbonated water discharged from the carbonated water tank 110 under high pressure is introduced into the carbonated water regulator 800 through the carbonated water inlet 812 of the carbonated water regulator 800.

The high-pressure carbonated water is then introduced into the second space 822 through the static pressure hole 802 after passing through the third space 824. During this procedure, the high-pressure carbonated water has influence on the end of the opening/closing member 804 and, as such, has influence on the bellows 810.

Thereafter, the carbonated water is discharged from the second space 822 through the carbonated water outlet 814.

Force generated when carbonated water passes through the carbonated water regulator 800 may be divided into 1) a force F1 to push the bellows 810 by the first regulator elastic member 806*a,* 2) a force F2 to push the opening/closing member 804 by the second regulator elastic member 806*b,* 3) a force F3 to push the bellows 810 by carbonated water, and 4) a force F4 to push the end of the opening/closing member 804 by carbonated water. As the force F1 is equal to the sum of the forces F2 to F4, the discharge pressure of the carbonated water is reduced and, as such, carbonated water is discharged from the carbonated water regulator 800 at a predetermined pressure.

Figure 10A:
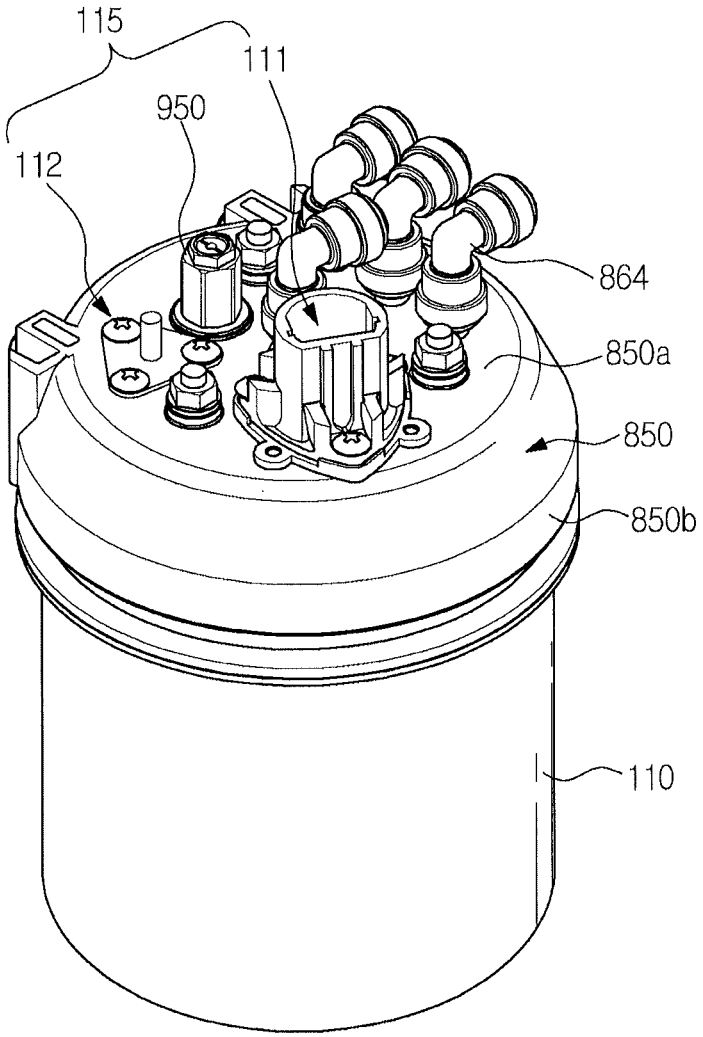
FIG. 10A is a perspective view illustrating a carbonated water tank and a holding unit according to an embodiment.
Figure 10B:
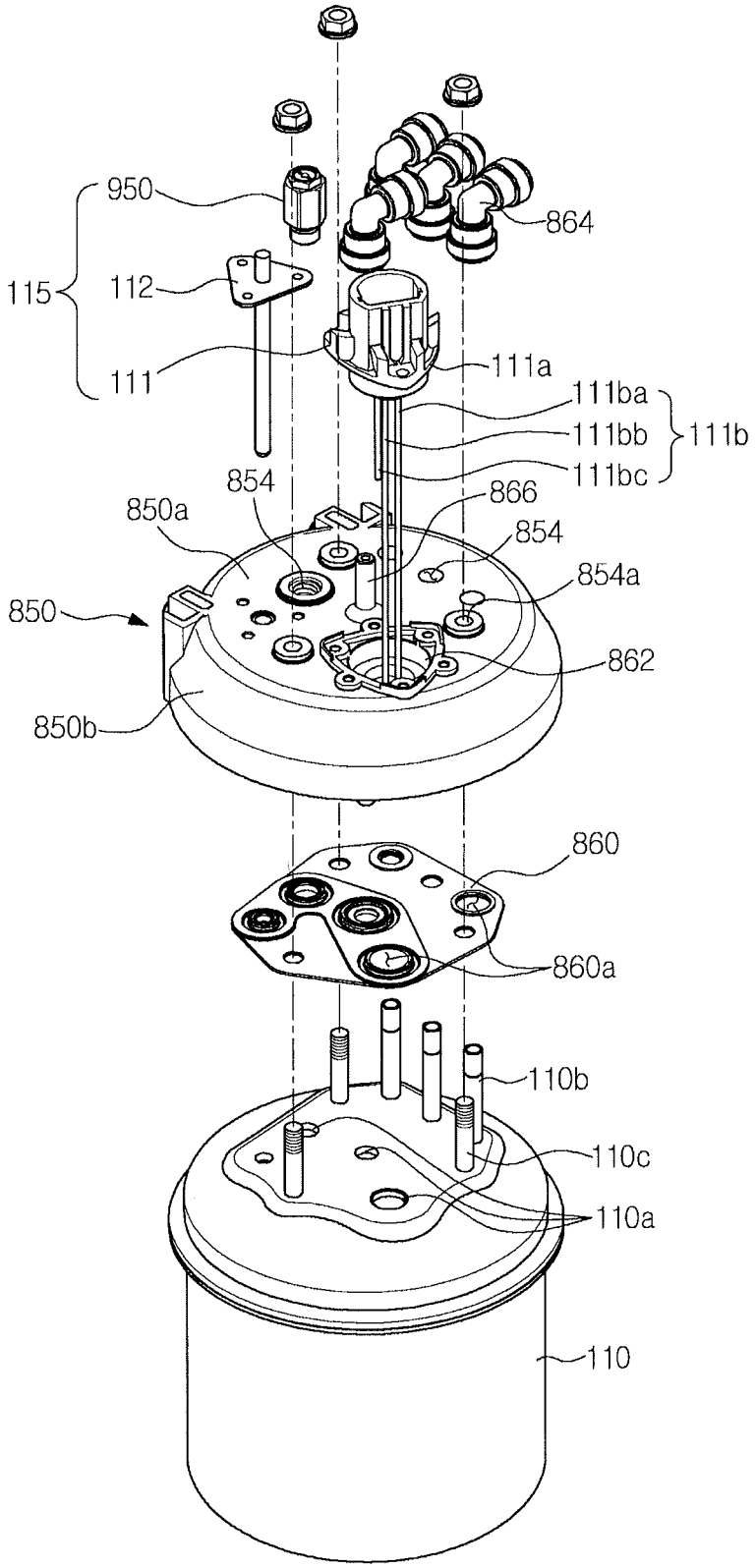
FIG. 10B is an exploded perspective view of the carbonated water tank and holding unit according to the illustrated embodiment.
Figure 10C:
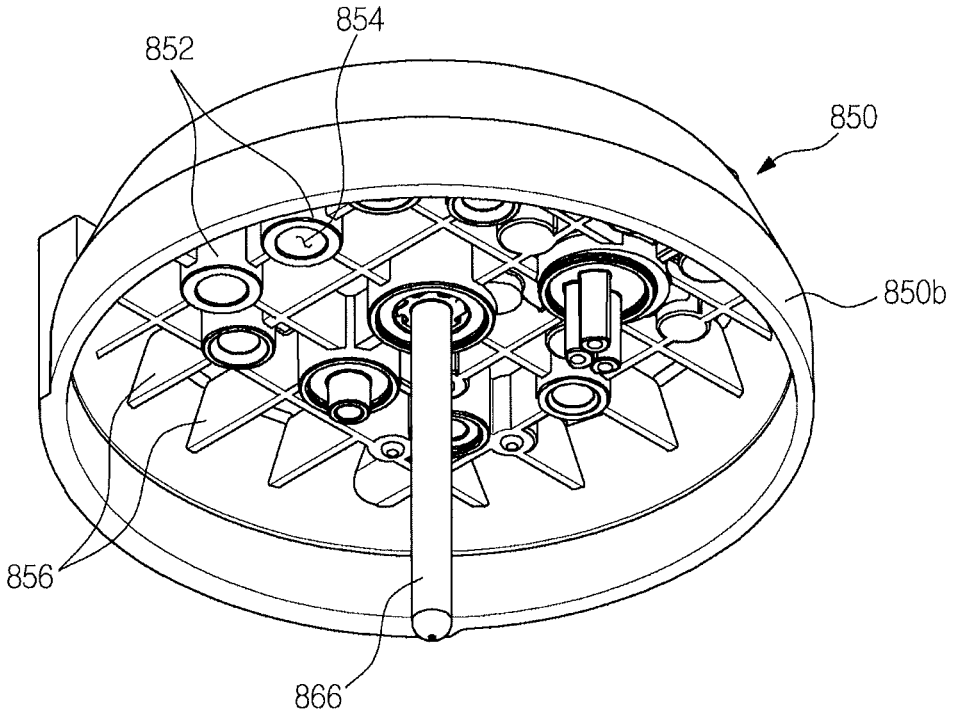
FIG. 10C is a perspective view illustrating a bottom of the holding unit.

FIG. 10A is a perspective view illustrating a carbonated water tank and a holding unit according to an embodiment. FIG. 10B is an exploded perspective view of the carbonated water tank and holding unit according to the illustrated embodiment. FIG. 100 is a perspective view illustrating a bottom of the holding unit.

The refrigerator according to the illustrated embodiment includes a body, a carbonated water tank 110 to produce carbonated water through mixing of clean water with carbon dioxide gas, a sensor unit 115 inserted, at least a portion thereof, into the carbonated water tank 110, to sense an internal state of the carbonated water tank 110, and a holding unit 850 disposed at one side of the carbonated water tank 110 while holding the sensor unit 115 in a fixed state.

The carbonated water tank 110 is configured to store high-pressure carbon dioxide gas and high-pressure carbonated water. The carbonated water tank 110 is formed to have a cylindrical shape, using a stainless steel material, taking into consideration an internal pressure exerting in the carbonated water tank 110. The sensor unit 115 is provided to measure a state of the carbonated water tank 110 including, for example, internal temperature and water level.

The sensor unit 115 is provided such that at least a portion thereof is inserted into the carbonated water tank 110. The carbonated water tank 110 is provided with a tank hole 110*a* to receive at least a portion of the sensor unit 115.

The holding unit 850 is disposed at one side of the carbonated water tank 110, to hold the sensor unit 115. The holding unit 850 may have various configurations, so long as it holds the sensor unit 115 while being supported by the carbonated water tank 110. In the illustrated embodiment, the holding unit 850 has a cover shape to enclose the tank hole 110*a* of the carbonated water tank 110.

Figure 11A:
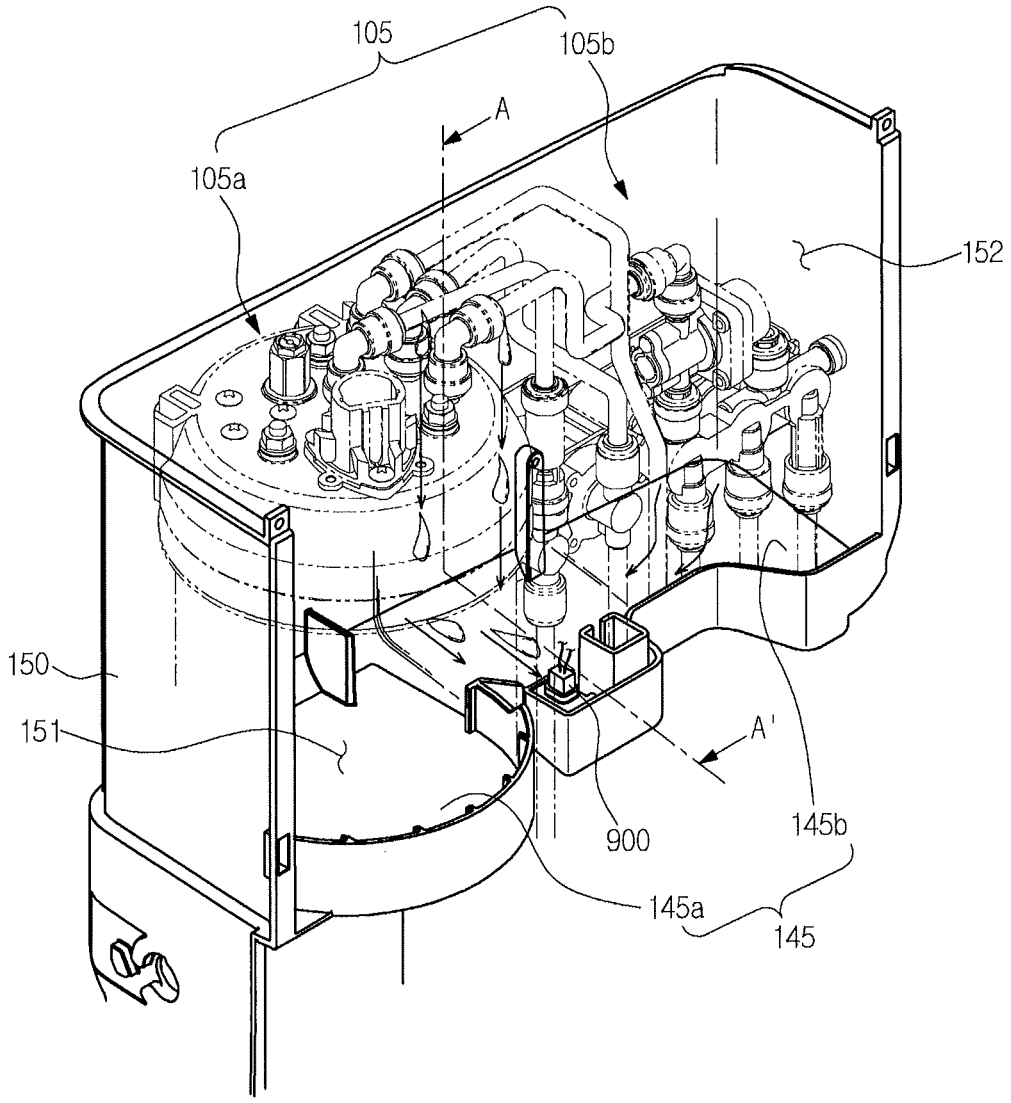
FIG. 11A is a perspective view illustrating arrangement of a water leakage sensor according to an embodiment.

In detail, the carbonated tank 110 is disposed in the first upper accommodation space while being seated on a first module support 145*a* (FIG. 11A). The tank hole 110*a* is provided at a top portion of the carbonated water tank 110. The holding unit 850 which has a cover shape is disposed over the carbonated water tank 110, to cover a portion of the carbonated water tank 110. The sensor unit 115 and fitting tubes are coupled to the holding unit 850 and, as such, the carbonated water tank 110 may be coupled with the sensor unit 115 and fitting tubes in accordance with coupling of the holding unit 850 to the carbonated water tank 110.

The holding unit 850 includes a holding plate 850*a*, to which the sensor unit 115 is fixed, and a plate support 850*b* extending from a peripheral portion of the holding plate 850*a* in a bent state, to enable the holding unit 850 to be supported by the carbonated water tank 110.

Holding plate holes 854 are provided at the holding plate 850*a* in order to hold the sensor unit 115. Threads are formed at the holding plate holes 854, to be threadedly coupled with threads formed at the sensor unit 115. Seats may also be provided at the holding plate 850*a*, to allow the sensor unit 115 to be seated on the holding plate 850*a*.

The holding plate holes 854 formed at the holding plate 850*a* include tube holes, in which fitting tubes 864 may be fitted, and coupling holes 854*a* to be coupled with coupling rods 110*c* provided at the carbonated water tank 110, respectively.

As described above, the plate support 850*b* extends from the peripheral portion of the holding plate 850*a* in a bent state. An end of the plate support 850*b* is mounted to a portion of the carbonated water tank 110. The holding plate 850*a* is spaced apart from a portion of the carbonated water tank 110 by the plate support 850*b* by a certain distance.

As described above, the holding unit 850 is coupled to the carbonated water tank 110 by the plate support 850*b*. In addition, the carbonated water tank 110 is provided with coupling rods 110*c* protruded from the top portion of the carbonated water tank 110 while being formed with threads at an upper end portion thereof, to have a bolt shape. Coupling holes 854*a* are also provided at the holding unit 850. Accordingly, it may be possible to firmly fix the holding unit 850 to the carbonated water tank 110 by extending the coupling rods 110*c* through respective coupling holes 854*a*, and then fastening nuts to respective coupling rods 110*c*.

A certain space is provided between the carbonated water tank 110 and the holding plate 850*a* of the holding unit 850. A gasket 860 is fitted in the space between the carbonated water tank 110 and the holding plate 850*a* of the holding unit 850, to prevent leakage of carbonated water or clean water from the carbonated water tank 110.

The gasket 860 is made of an elastic material. The gasket 860 is provided with gasket holes 860*a* to allow the sensor unit 115 and coupling rods 110*c* to extend therethrough. The gasket 860 contacts the carbonated water tank 110. In an embodiment of the present invention, the gasket 860 is made of a silicon material.

For coupling of the sensor unit 115 and tubes to feed carbon dioxide gas, clean water, and carbonated water, the holding plate 850*a* of the holding unit 850 is provided with seats for the sensor unit 115 and fitting tubes 864, in addition to the holding plate holes 854.

The sensor unit 115 includes a water level sensor 111 to sense the level of water in the carbonated water tank 110, a relief sensor to control an excessive pressure, and a temperature sensor 112 to sense the temperature of carbonated water in the carbonated water tank 110.

The water level sensor 111 is provided with a sensor flange 111*a* to be seated on the top portion of the holding unit 850. In addition, a concave sensor seat 862 is provided at an upper surface of the holding plate 850*a*, to allow the sensor flange 111*a* to be seated thereon.

As the sensor flange 111*a* formed at one end of the water level sensor 111 is seated on and coupled to the holding unit 850, the water level sensor 111 is fixedly mounted to the holding unit 850. Water level sensing rods 111*b* are provided at the other end of the water level sensor 111. The water level sensing rods 111*b* extend through the carbonated water tank 110. The water level sensing rods 111*b* include a ground rod 111*ba* to set a reference for sensing of water level, a low water level sensing rod 111*bb* having a long length, to approach a bottom of the carbonated water tank 110 so as to sense a low water level, and a high water level sensing rod 111 be having a shorter length than the low water level sensing rod 111*bb*, to approach a top of the carbonated water tank 110 so as to sense a high water level.

The carbonated water tank 110 may be configured to communicate with the clean water supply line 210, clean water discharge line 220, carbonated water discharge line 230, and carbon dioxide gas supply line 200, for introduction and discharge of clean water, carbon dioxide gas, and carbonated water.

The above-described lines may be directly coupled to the carbonated water tank 110. In the illustrated embodiment, however, the lines may be coupled to respective fitting tubes 864 provided at the holding unit 850, taking into consideration environments such as pressure, and, as such, may be firmly connected to the carbonated water tank 110.

Each fitting tube 864 is fixed, at one end thereof, to the holding unit 850, and is connected, at the other end thereof, to an associated one of the lines. A passage is formed through the fitting tube 864, to allow clean water, carbon dioxide gas, or carbonated water to pass therethrough.

As described above, one end of each fitting tube 864 is coupled to the holding unit 850. For this coupling, the carbonated water tank 110 is provided with a tube-shaped line guide 110*b* having a hollow portion while being protruded from the carbonated water tank 110 at a position corresponding to each fitting tube 864. An end of the line guide 110*b* contacts the holding unit 850, to be connected with the fitting tube 864.

A carbon dioxide gas nozzle 866 is provided at the holding plate 850*a*. Carbon dioxide gas from the carbon dioxide gas cylinder 120 is introduced into the carbon dioxide gas nozzle 866. An end of the carbon dioxide gas nozzle 866 may be inserted into the carbonated water tank 110 and, as such, may directly inject carbon dioxide gas into the carbonated water tank 110.

A lattice-shaped reinforcement member 856 may be provided at a lower surface of the holding plate 850*a*, in order to enable the holding plate 850*a* to sufficiently endure high pressure of carbon dioxide gas and carbonated water. The reinforcement member 856 may include a plurality of longitudinal and lateral ribs spaced apart from one another by a uniform distance. In accordance with this structure, it may be possible to enhance strength of the holding unit 850.

As described above, the holding plate holes 854 are provide at the holding plate 850*a*, for holding the sensor unit 115. Unit guides 852 are provided at the lower surface of the holding plate 850*a*, to guide the sensor unit 115 extending through the holding plate holes 854.

In detail, the unit guides 852 are provided at the reinforcement member 856 on the lower surface of the holding plate 850*a*. Each unit guide 852 has a cylindrical structure extending downward while having a hollow portion. Through such a configuration, accordingly, the sensor unit 115 and lines may be more stably held by the holding unit 850.

Hereinafter, coupling of the holding unit 850 and carbonated water tank 110 according to the above-described configurations will be described.

The sensor unit 115 and fitting tubes 863 are firmly held by the holding unit 850. Holding of the sensor unit 115 and fitting tubes 864 may be achieved by bring flanges of the sensor unit 115 and fitting tubes 864 into contact with the holding plate 850*a* of the holding unit 850, and then threadedly fastening the sensor unit 115 and fitting tubes 864 to the holding plate 850*a*. Since threads are formed at the sensor unit 115 and fitting tubes 864, they may be coupled with threads provided at the holding plate holes 854 of the holding unit 850. Through such coupling, the holding unit 850, sensor unit 115, and lines may be integrated.

It may be possible to insert at least a portion of the sensor unit 115 into the carbonated water tank 110, and to connect the fitting tubes 864 to the carbonated water tank 110 by coupling the sensor unit 115 and fitting tube 864 to the holding unit 850, and then coupling the holding unit 850 to the top portion of the carbonated water tank 110.

Through the above-described configuration, it may be possible to firmly couple the sensor unit 115 and lines to the carbonated water tank 110, which has high internal pressure due to carbon dioxide gas and carbonated water.

Figure 11B:
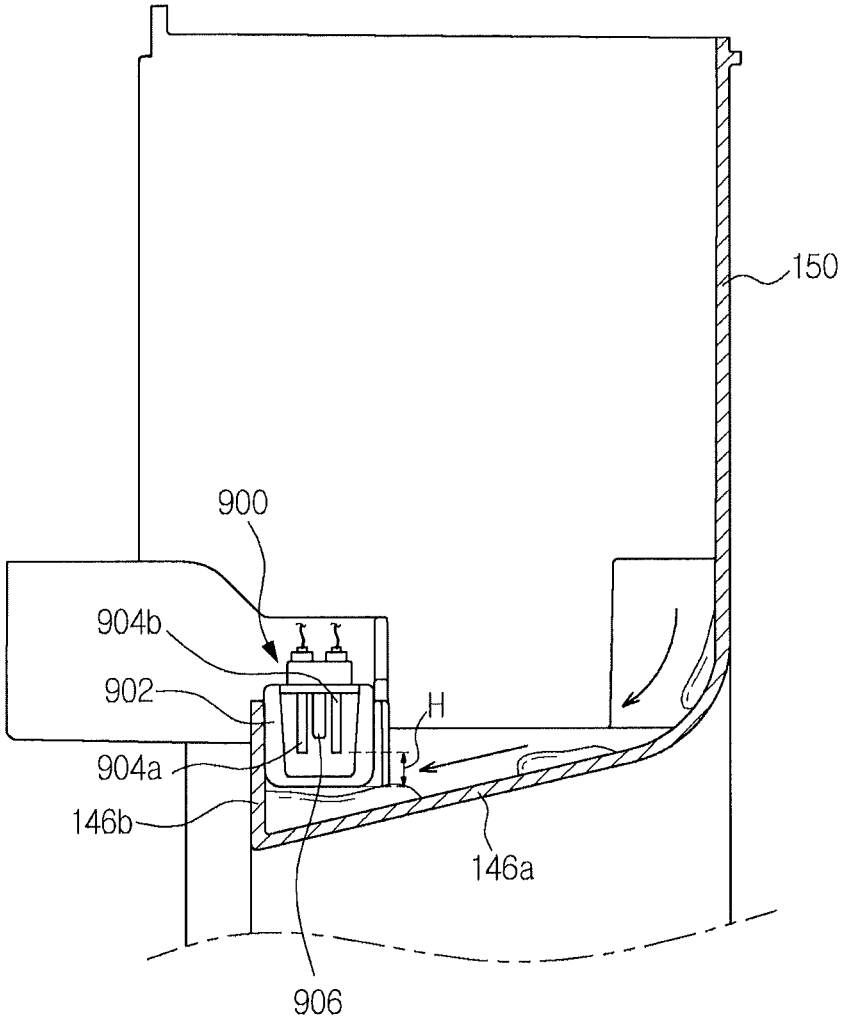
FIG. 11B is a cross-sectional view taking along the line A-A' of FIG. 11A.
Figure 11C:
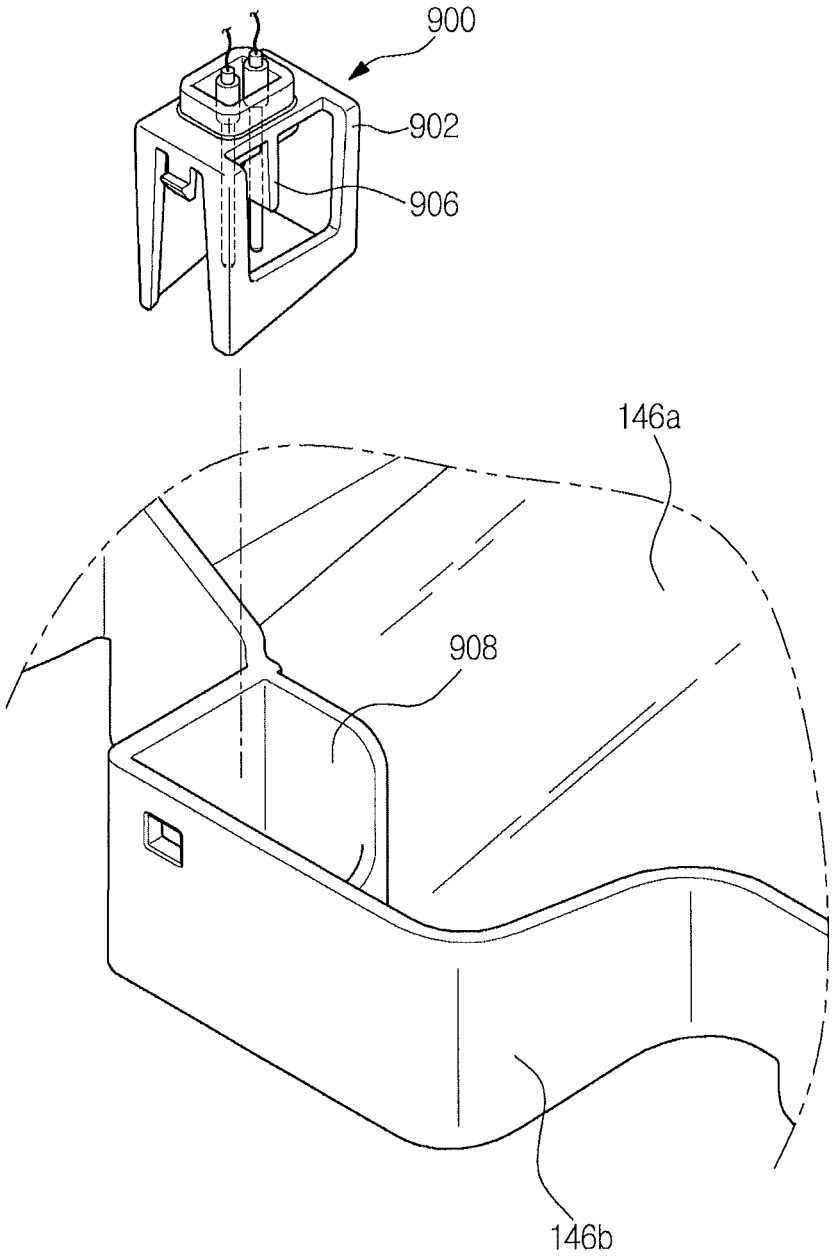
FIG. 11C is a view illustrating coupling of the water leakage sensor according to the illustrated embodiment.
Figure 11D:
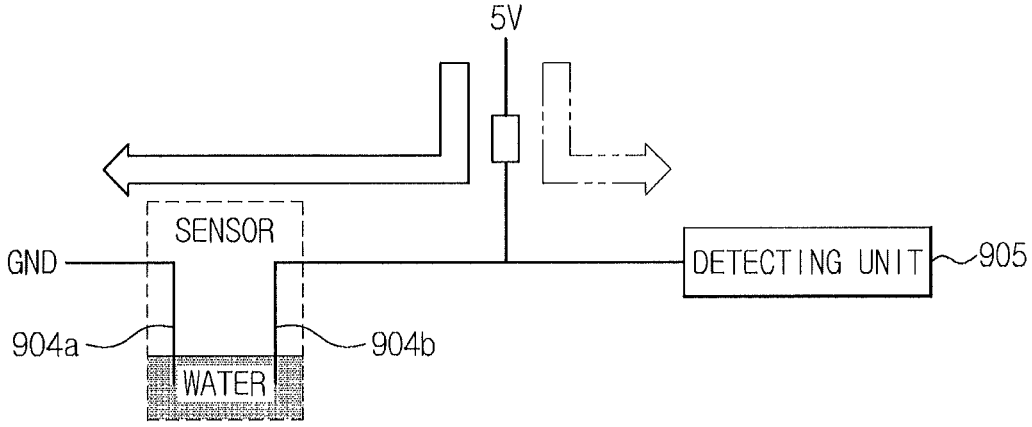
FIG. 11D is a view illustrating operation of the water leakage sensor according to the illustrated embodiment.

FIG. 11A is a perspective view illustrating arrangement of the water leakage sensor according to an embodiment. FIG. 11B is a cross-sectional view taking along the line A-A' of FIG. 11A. FIG. 11C is a view illustrating coupling of the water leakage sensor according to the illustrated embodiment. FIG. 11D is a view illustrating operation of the water leakage sensor according to the illustrated embodiment. In the following description, constituent elements identical to those of the above-described embodiments will be designated by the same reference numerals, respectively, and no description thereof will be given.

In accordance with an embodiment, the refrigerator includes a body, a storage chamber defined in the body while having an opened front side, a door to open or close the opened front side of the storage chamber, and a water tank to store clean water. The refrigerator also includes a carbon dioxide gas cylinder 120 storing carbon dioxide gas, a carbonated water tank 110 to produce carbonated water through mixing of clean water with carbon dioxide gas, a carbonated water production module having a module support 145 to support a bottom of the carbonated water tank 110 while being mounted to a back surface of the door, and a water leakage sensor 900 provided at the module support 145, to sense water leakage occurring at the carbonated water production module.

The carbonated water production module includes a module case 140 including a lower accommodation space 153 to receive the carbon dioxide gas cylinder 120, a first upper accommodation space 151 to receive the carbonated water tank 110, and a second upper accommodation space 152 to receive a valve assembly 130.

The carbonated water production module also includes an upper module 105. The upper module 105 includes a first upper module 105*a* having the first upper accommodation space 151, and a second upper module 105*b* having the second upper accommodation space 152.

The module support 145 partitions the upper accommodation spaces 151 and 152 from the lower accommodation space 153 in the module case 140. The module support 145 is configured to close or seal lower portions of the upper accommodation spaces 151 and 152 in order to allow water leaked from the carbonated water tank 110 or valve assembly 130 to be accumulated in the upper accommodation spaces 151 and 152.

The module support 145 includes a first module support 145*a* to support a bottom of the first upper accommodation space 151, in which the carbonated water tank 110 is accommodated, and a second module support 145*b* to support a bottom of the second upper accommodation space 152, in which the valve assembly 130 is accommodated.

The module support 145 also includes a module support bottom portion 146*a* to form a bottom of the module support 145, and a module support guide portion 146*b* extending upward from a peripheral edge of the module support bottom portion 146*a* in a bent state.

The bottom support 155 and guide 156 may be formed on the module support bottom portion 146*a*. As described above, the carbonated water tank 110 is seated on the bottom support 155. The guide 156 extends upward from the peripheral portion of the bottom support 155 in a bent state.

The water leakage sensor 900 is disposed on the module support bottom portion 146*a*, to sense water leakage occurring in configurations disposed on the module support 145, for example, the carbonated water tank 110, the lines to guide carbonated water and clean water, and the valve assembly 130.

The module support bottom portion 146*a* has an inclined surface at least a part thereof, and includes a first section disposed at one side of the inclined surface, namely, a lower side of the inclined surface, and a second section disposed at the other side of the inclined surface, namely, a higher side of the inclined surface, such that the second section is disposed at a higher level than the first section. The water leakage sensor is disposed on the first section of the module support bottom portion 146*a*.

The module support bottom portion 146*a* may be inclined such that one side of the module support bottom portion 146*a* toward the door is higher than the other side of the module support bottom portion 146*a*. In this case, the water leakage sensor 900 may be disposed on the other side of the module support bottom portion 146*a*. Accordingly, when water leakage occurs, leaked water is collected on the module support bottom portion 146*a* even if the amount of leaked water is little. In this case, since the water leakage sensor 900 is disposed at the lower side of the module support bottom portion 146*a*, namely, the other side of the module support bottom portion 146*a*, it may be possible to more rapidly sense water leakage.

The water leakage sensor 900 includes a sensor housing 902, and a plurality of terminals 904*a* and 904*b*.

The sensor housing 902 defines an appearance of the water leakage sensor 900, and is opened at least one side thereof. In the illustrated embodiment, the sensor housing 902 is opened at one side thereof, to receive leaked clean water or carbonated water.

The sensor housing 902 is seated on a sensor seat 908 provided at the module support bottom portion 146*a*. The sensor seat 908 is shaped to protrude upward from the module support bottom portion 146*a* in order to enclose a peripheral portion of the sensor housing 902.

The terminals 904*a* and 904*b* are disposed in the sensor housing 902, to sense leakage of water and then to convert the sensed results into an electrical signal. In order to prevent trace amounts of water formed during use of the refrigerator due to moisture or the like from being erroneously sensed as water leakage, the terminals 904*a* and 904*b* are upwardly spaced apart from the bottom of the module support 145 by a predetermined height H. The predetermined height H is higher than a level of trace amounts of water accumulated after being formed during use of the refrigerator due to moisture or the like. The first height H may be varied in accordance with use environment and setting.

The terminals 904*a* and 904*b* are partitioned from each other by a sensor partition plate 906 disposed between the terminals 904*a* and 904*b* and, as such, are prevented from electrically contacting each other. In the illustrated embodiment, two terminals, namely, the first terminal 904*a* and the second terminal 904*b*, are partitioned from each other by the sensor partition plate 906.

In the illustrated embodiment, the plurality of terminals 904*a* and 904*b* include the first terminal 904*a*, which is connected to an electrical ground, and the second terminal 904*b*, which is connected to a voltage source.

The second terminal 904*b* is connected to a detecting unit 905 while being connected to the voltage source. In the illustrated embodiment, the voltage source is a 5V voltage source, and is connected to the detecting unit 905 and second terminal 904*b*.

When there is no water leakage, current constantly flows through a circuit between the voltage source and the detecting unit 905. However, when water leakage occurs, current flowing to the detecting unit 905 is varied in amount because the first and second terminals 904*a* and 904*b* are electrically connected by leaked clean water or carbonated water. In this case, a control unit (not shown) senses the current amount variation, and then displays occurrence of water leakage on the display provided at the front side of the door 21 or 22.

The water leakage sensor 900 is electrically connected to the control unit (not shown). Accordingly, when the water leakage sensor 900 senses leakage of water, the control unit closes the valve assembly 130 and each valve, which are electrically connected to the control unit, to close lines of clean water, carbonated water, and carbon dioxide gas. In this case, accordingly, it may be possible to prevent further production of carbonated water, for safety.

Hereinafter, operation of the water leakage sensor 900 having the above-described configuration will be described.

When there is no water leakage, the amount of current flowing from the voltage source of the water leakage sensor 900 to the detecting unit 905 is constant.

When water leakage occurs at the carbonated water tank 110, the line of carbonated water or clean water, or the valve installed at the line, leaked water drops onto the inclined module support bottom portion 146*a*, and then moves to a lower place on the module support bottom portion 146*a* along the module support bottom portion 146*a*. As a result, leaked clean water or carbonated water is introduced into the opened side of the water leakage sensor 900 positioned at the lower place of the inclined module support bottom portion 146*a*, thereby causing the first and second terminals 904*a* and 904*b* to be electrically connected.

In this case, current which has constantly flowed from the voltage source to the water leakage sensor 905 is varied in amount due to current flowing to the first terminal 904*a* via the second terminal 904*b* because the second terminal 904*b* is electrically connected with the electrical ground, namely, the first terminal 904*a*.

Current variation is sensed by the control unit (not shown) which, in turn, closes the lines of carbon dioxide gas, clean water, and carbonated water while stopping production of carbonated water.

The control unit (not shown) also informs occurrence of water leakage through the display provided at the front side of the door. Thus, it may be possible to inform whether failure has occurred, thereby preventing property damage caused by water leakage.

Figure 12A:
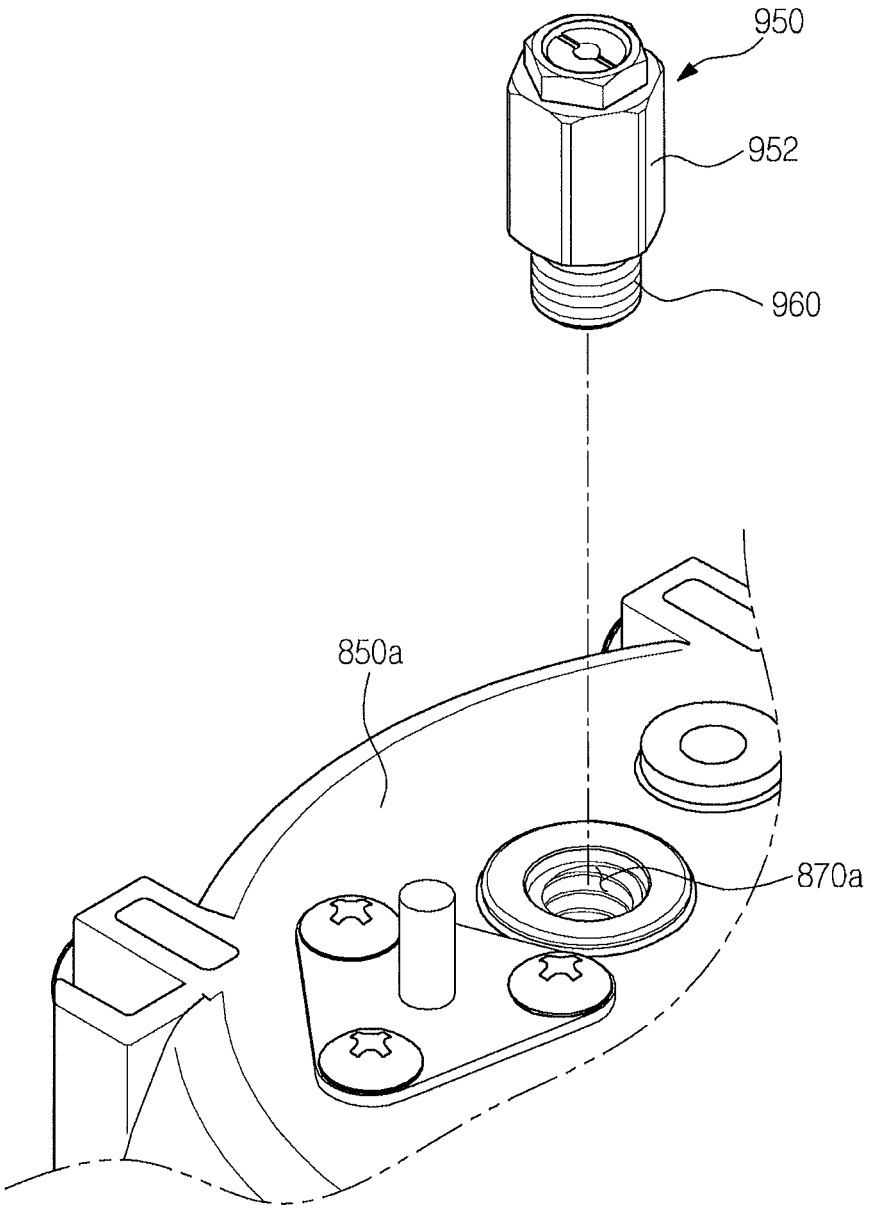
FIG. 12A is a perspective view illustrating an arrangement of a relief valve according to an embodiment.
Figure 12B:
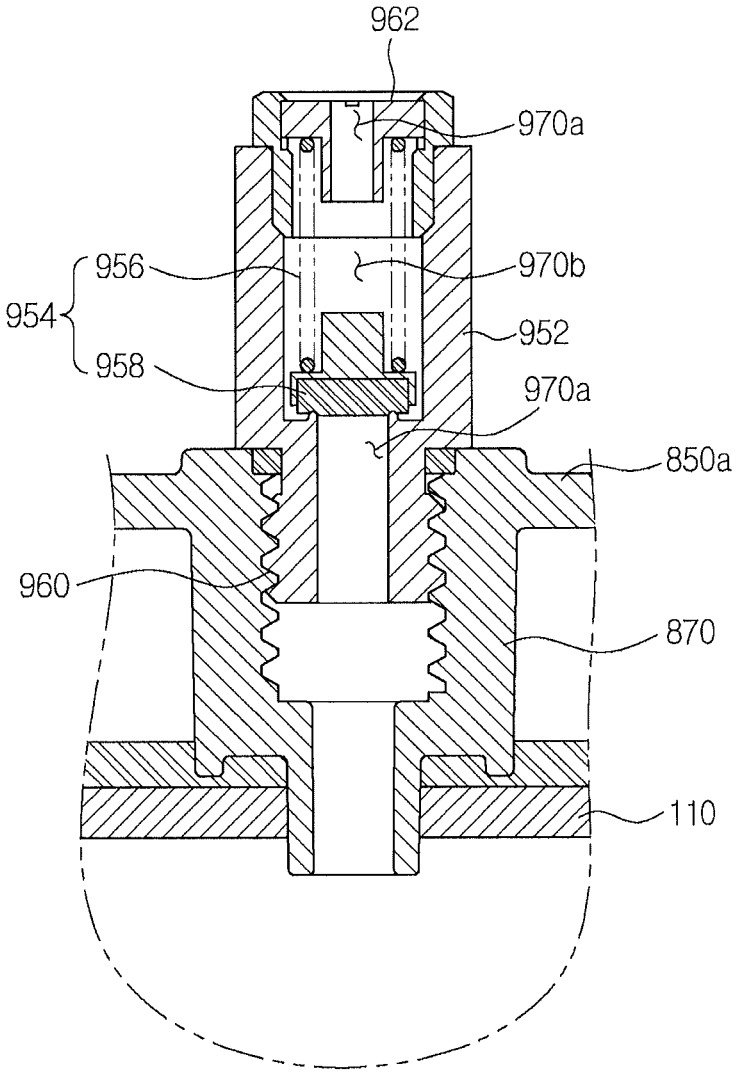
FIG. 12B is a sectional view illustrating a coupled state of the relief valve according to the illustrated embodiment.
Figure 12C:
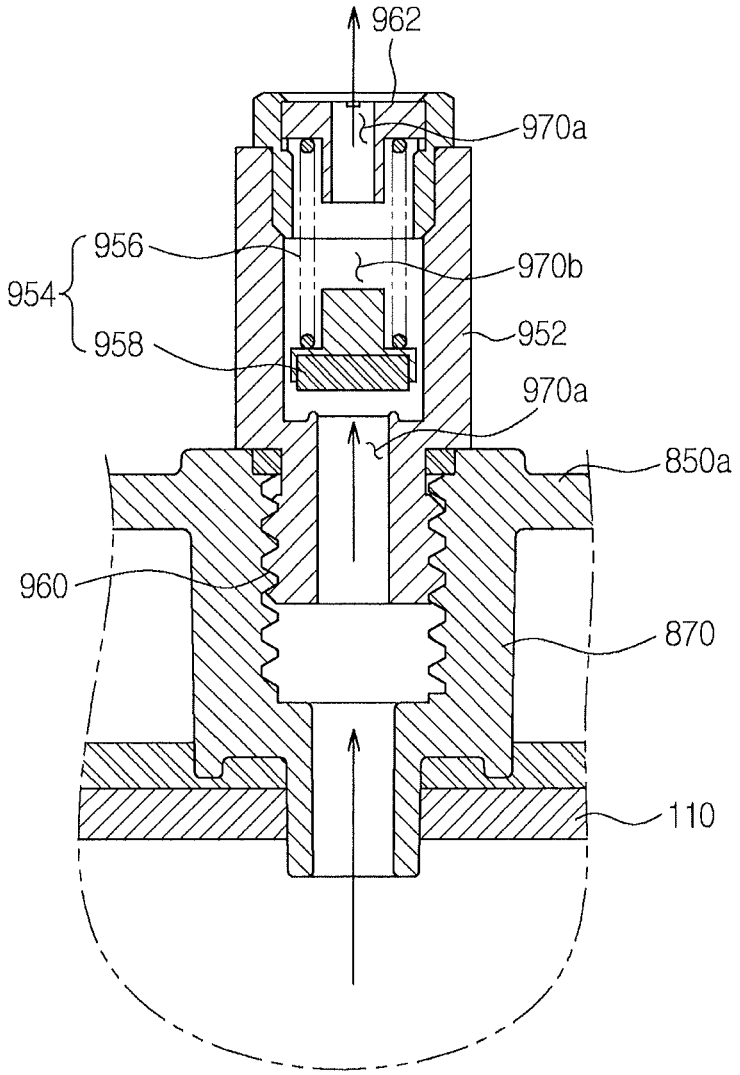
FIG. 12C is a view illustrating operation of the relief valve according to the illustrated embodiment.

FIG. 12A is a perspective view illustrating an arrangement of the relief valve according to an embodiment. FIG. 12B is a sectional view illustrating a coupled state of the relief valve according to the illustrated embodiment. FIG. 12C is a view illustrating operation of the relief valve according to the illustrated embodiment. In the following description, constituent elements identical to those of the above-described embodiments will be designated by the same reference numerals, respectively, and no description thereof will be given.

In accordance with an embodiment, the refrigerator includes a body, a storage chamber defined in the body while having an opened front side, a door to open or close the opened front side of the storage chamber, a water tank to store clean water, and a carbonated water production module provided at a back surface of the door, to produce carbonated water. The carbonated water production module includes a carbon dioxide gas cylinder 120 storing high-pressure carbon dioxide gas, a carbonated water tank 110 to produce carbonated water through mixing of clean water with carbon dioxide gas, and a relief valve 950 provided to be opened or closed, based on a predetermined pressure, and thus to prevent the carbonated water tank 110 from being excessively pressurized.

The relief valve 950 may be directly coupled to the carbonated water tank 110. In an embodiment of the present invention, however, the relief valve 950 is coupled to a holding unit 850, to which a sensor unit 115 including various sensors and lines is coupled.

The holding unit 850 includes a relief valve guide hole 870*a* formed with threads at an inner surface thereof.

The relief valve 950 includes a relief valve coupling portion 960 formed, at an outer peripheral surface thereof, with threads to be threadedly coupled with the relief valve guide hole 870*a*.

The relief valve 950 may have various configurations, so long as it may be firmly coupled to the holding unit 850. Through the above-described configuration, coupling of the relief valve 950 may be achieved by directly coupling the relief valve coupling portion 960 of the relief valve 950 to the relief valve guide hole 870*a* of the holding unit 850.

A relief valve guide 870 is provided at a lower surface of a holding plate 850*a* included in the holding unit 850, to guide the relief valve 950. The relief valve guide 870 is provided at a holding plate reinforcement member 856 formed on the lower surface of the holding plate 850*a*. The relief valve guide 870 has a hollow structure including a relief valve guide hole 870*a* while extending downward. When the holding unit 850 is coupled to the carbonated water tank 110, at least a portion of the relief valve guide 870 or relief valve 950 is inserted into the carbonated water tank 110 and, as such, the relief valve 950 is more stably fixed to the holding unit 850.

The relief valve 950 includes a relief valve body 952, and a valve opening/closing unit 954 to move selectively through the relief valve body 952 in an extension or retraction direction.

The relief valve body 952 defines an appearance of the relief valve 950. The relief valve body 952 is formed with a passage 970*a* extending between opposite sides of the relief valve body 952, to allow carbon dioxide gas to pass there through. The relief valve body 952 has a cylindrical outer structure. In an embodiment of the present invention, the relief valve body 952 has an axially elongated nut shape.

The valve opening/closing unit 954 is provided at the passage 970*a*, to selectively allow high-pressure carbon dioxide gas to pass through the passage 970*a*.

The valve opening/closing unit 954 includes a valve elastic member 956 fixed, at one end thereof, while being movable at the other end thereof in an extension or retraction direction. The valve opening/closing unit 954 also includes a relief plate 958 provided at the other end of the valve elastic member 956, to compress the valve elastic member 956 when the internal pressure of the carbonated water tank 110 is equal to or higher than a predetermined pressure, in order to open the passage 970*a*.

The valve elastic member 956 always pushes the relief plate 958 such that the relief plate 958 is prevented from being spaced apart from the passage 970*a* when the internal pressure of the carbonated water tank 110 is below the predetermined pressure.

In a normal state, the relief plate 958 blocks the passage 970*a* at one side thereof. In this case, the other side of the relief plate 958 is supported by the valve elastic member 956, to be prevented from being spaced apart from the passage 970*a*.

The relief valve 950 includes the passage 970*a* extending between opposite sides of the relief valve body 952, and an opening/closing space 970*b* provided at the passage 970*a* in the relief valve body 952 while having a greater diameter than the passage 970*a*. In the opening/closing space 970*b*, the valve elastic member 956 and relief plate 958 are disposed.

The passage 970*a* communicates with a hollow portion of the relief valve guide 870, to receive high-pressure carbon dioxide gas from the carbonated water tank 110. The passage 970*a* guides the received high-pressure carbon dioxide gas, to allow the high-pressure carbon dioxide gas to be outwardly discharged from the carbonated water tank 110. The opening/closing space 970*b* is a space formed at the passage 970*a*, to accommodate the valve opening/closing unit 954 to selectively open the passage 970*a*.

High-pressure carbon dioxide gas introduced into the passage 970*a* of the relief valve 950 at one side of the passage 970*a* is discharged from the passage 970*a* through the other side of the passage 970*a*. A sound absorber 962 is provided at the other side of the passage 970*a*, to reduce noise generated during injection of high-pressure carbon dioxide gas.

Carbon dioxide gas emerging from the relief valve 950 is injected into the carbonated water production module.

Hereinafter, operation of the relief valve 950 having the above-described configuration will be described.

High-pressure carbon dioxide gas from the carbon dioxide gas cylinder 120 is introduced into the carbonated water tank 110. The pressure of carbon dioxide gas in the carbon dioxide gas cylinder 120 is 45 to 60 bars. Such high-pressure carbon dioxide gas is introduced into the carbonated water tank 110 under the condition that the pressure of the carbon dioxide gas is reduced to 10 bars or below by the gas regulator 201. Carbon dioxide gas is mixed with clean water in the carbonated water tank 110, thereby producing carbonated water. The produced carbonated water is discharged into the dispensation space by the high pressure of carbon dioxide gas in the carbonated water tank 110.

When the pressure of carbon dioxide gas in the carbonated water tank 110 exceeds 10 bars, the carbonated water tank 110 may be damaged. In this case, accordingly, the relief valve 950 operates.

In detail, the pressure of the carbonated water tank 110 always pushes the relief plate 958 disposed at the passage 970*a* of the relief valve 950. When the internal pressure of the carbonated water tank 110 is equal to or greater than a first pressure, namely, 10 bars, the force to push the relief plate 958 at one side of the relief plate 958 by high-pressure carbon dioxide gas in the carbonated water tank 110 is greater than the force to push the relief plate 958 at the other side of the relief plate 958 by the valve elastic member 956. In this case, accordingly, the valve elastic member 956 is compressed and, as such, the relief plate 958 no longer blocks the passage 970*a*. As a result, the passage 970*a* is opened and, as such, carbon dioxide gas is outwardly discharged from the carbonated water tank 110 through the passage 970*a*.

When it is assumed that, as forces acting on the relief plate 958, there are a first force to push the relief plate 958 by high-pressure carbon dioxide gas in the carbonated water tank 110 and a second force to push the relief plate 958 by the valve elastic member 956 in the relief valve 950, the passage 970*a* is opened, starting from the time when the first force is greater than the second force and, as such, high-pressure carbon dioxide gas is discharged. When the pressure of carbon dioxide gas in the carbonated water tank 110 is reduced to the first pressure or below, that is, when the second force is greater than the first force, the passage 970*a* is again blocked by the relief plate 958. In this case, high-pressure carbon dioxide gas is no longer outwardly discharged from the carbonated water tank 110.

As apparent from the above description, the refrigerator which is equipped with a carbonated water production apparatus according to an aspect of the present disclosure is configured to achieve strong coupling exhibiting high resistance to pressure while achieving an enhancement in work efficiency when a sensor and lines are coupled to a carbonated water tank.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a body;

a carbonated water tank provided at an interior of the body, to produce carbonated water through mixing of clean water with carbon dioxide gas;

a sensor unit to sense an internal state of the carbonated water tank; and a holding unit seated on a top of the carbonated water tank, to hold lines to guide the clean water, the carbon dioxide gas and the carbonated water to be introduced into and discharged from the carbonated water tank, and to hold the sensor unit, wherein the holding unit comprises a holding plate, to which the sensor unit is fixed, and a lattice-shaped reinforcement member provided at a lower surface of the holding plate.

2. The refrigerator according to claim 1, wherein the holding unit has a cover shape to cover one side of the carbonated water tank.

3. The refrigerator according to claim 1, wherein the holding unit comprises:

a plate support provided at a peripheral portion of the holding plate, to be supported by the carbonated water tank.

4. The refrigerator according to claim 1, further comprising:

a gasket provided between the carbonated water tank and the holding unit such that the gasket contacts one side of the carbonated water tank, to prevent occurrence of water leakage from the carbonated water tank.

5. The refrigerator according to claim 1, wherein the carbonated water tank comprises a tank hole formed at one side of the carbonated water tank, to receive at least a portion of the sensor unit.

6. The refrigerator according to claim 3, wherein the holding unit further comprises:

a unit guide extending from a lower surface of the holding plate, to have a protruded shape, the unit guide having a hollow portion to guide the sensor unit.

7. The refrigerator according to claim 1, wherein:

the sensor unit comprises a water level sensor; and the holding unit comprises a sensor seat to fix the water level sensor.

8. The refrigerator according to claim 7, wherein the water level sensor comprises a sensor flange provided at one end of the water level sensor, to be seated on the sensor seat.

9. The refrigerator according to claim 7, wherein the water level sensor is fixed, at one end thereof, to the holding unit while being provided, at the other end thereof, with a water level sensing rod extending into the carbonated tank.

10. The refrigerator according to claim 9, wherein the water level sensing rod comprises:

a ground rod to set a reference for sensing of a water level;

a low water level sensing rod having a long length, to approach a bottom of the carbonated water tank so as to sense a low water level; and a high water level sensing rod having a shorter length than the low water level sensing rod, to approach the top of the carbonated water tank so as to sense a high water level.

11. The refrigerator according to claim 1, further comprising:

lines to guide the clean water, the carbon dioxide gas, and the carbonated water, wherein the holding unit comprises fitting tubes each fixed, at one end thereof, to the holding unit while communicating, at the other end thereof, with a corresponding one of the lines.

12. The refrigerator according to claim 11, wherein the carbonated water tank is provided, at one side thereof, with line guides extending from the carbonated water tank, to have a protruded shape, each of the line guides having hollow portion to be coupled, at an end thereof, with one end of a corresponding one of the fitting tubes.

13. The refrigerator according to claim 1, further comprising:

a water tank to store the clean water; and a carbon dioxide gas cylinder stored with the carbon dioxide gas.

14. The refrigerator according to claim 1, wherein the sensor unit is threadedly coupled to the holding unit.

15. The refrigerator according to claim 1, wherein the carbonated water tank is made of a stainless steel material.

16. A refrigerator comprising:

a body;

a storage chamber defined in the body while having an opened front side;

a door to open or close the opened front side of the storage chamber;

a water tank to store clean water;

a carbonated water production module mounted to a back surface of the door, the carbonated water production module comprising a carbon dioxide gas cylinder stored with carbon dioxide gas, and a carbonated water tank to produce carbonated water through mixing of the clean water with the carbon dioxide gas;

a sensor unit to sense an internal state of the carbonated water tank; and a holding unit disposed at one side of the carbonated water tank while holding the sensor unit and lines to guide the clean water and the carbon dioxide gas in a fixed state.

17. The refrigerator according to claim 16, further comprising:

a gasket provided between the carbonated water tank and the holding unit such that the gasket contacts one side of the carbonated water tank, to prevent leakage of the carbonated water.

18. The refrigerator according to claim 16, wherein the sensor unit comprises at least one of:

a water level sensor to sense a water level of the carbonated water tank;

a relief valve to adjust an excessive internal pressure of the carbonated water tank; and a temperature sensor to sense a temperature of the carbonated water in the carbonated water tank.

19. A refrigerator comprising:

a body;

a storage chamber defined in the body while having an opened front side;

a door to open or close the opened front side of the storage chamber; and a carbonated water production module mounted to a back surface of the door, to produce carbonated water, wherein the carbonated water production module comprises:

a carbon dioxide gas cylinder stored with carbon dioxide gas, a carbonated water tank to produce and store carbonated water, and a holding unit disposed at one side of the carbonated water tank while being inserted, at least a portion thereof, into the carbonated water tank, to hold at least one sensor unit in a fixed state.

20. The refrigerator according to claim 19, further comprising:

a gasket provided between the carbonated water tank and the holding unit such that the gasket contacts one side of the carbonated water tank, to prevent occurrence of water leakage from the carbonated water tank.

21. A refrigerator comprising:

a body;

a storage chamber defined in the body while having an opened front side;

a door to open or close the opened front side of the storage chamber; and a carbonated water production module mounted to a back surface of the door, to produce carbonated water, wherein the carbonated water production module comprises:

a carbon dioxide gas cylinder stored with carbon dioxide gas, a carbonated water tank to produce carbonated water through mixing of clean water with the carbon dioxide gas, and to store the produced carbonated water, lines to guide the clean water, the carbon dioxide gas and the carbonated water to be introduced into and discharged from the carbonated water tank, and a holding unit coupled to a top of the carbonated water tank, to hold the lines in a fixed state, the lines extending through the holding unit.

22. The refrigerator according to claim 21, further comprising:

a sensor unit to sense an internal state of the carbonated water tank, wherein the sensor unit is held by the holding unit, and has at least a portion extending into the carbonated water tank.

23. The refrigerator according to claim 21, further comprising:

a gasket provided between the carbonated water tank and the holding unit such that the gasket contacts one side of the carbonated water tank, to prevent occurrence of water leakage from the carbonated water tank.

24. A refrigerator comprising:

a body;

a carbonated water tank provided at an interior of the body, to produce carbonated water through mixing of clean water with carbon dioxide gas;

a gas regulator to reduce a pressure of the supplied carbon dioxide from a carbon dioxide gas cylinder to the carbonated water tank;

a sensor unit to sense an internal state of the carbonated water tank;

a holding unit seated on a top of the carbonated water tank, to hold lines to guide the clean water, the carbon dioxide gas and the carbonated water to be introduced into and discharged from the carbonated water tank, and to hold the sensor unit; and a safety device comprising a cylinder connector to be coupled to one side of the carbon dioxide gas cylinder, the safety device being pivotable to selectively move in an extension or retraction direction such that the carbon dioxide gas cylinder and the gas regulator selectively come into contact with each other.

25. The refrigerator according to claim 24, wherein the sensing unit further comprises a relief valve to relieve a pressure of the carbonate water tank if the pressure within the carbonated water tank is too high.

* * * * *